US007681769B2

(12) United States Patent
Kramer

(10) Patent No.: US 7,681,769 B2
(45) Date of Patent: Mar. 23, 2010

(54) DUAL POSITION BACKPACK

(76) Inventor: Robert F. Kramer, 976 Cameron Dr., Folsom, CA (US) 95630

( * ) Notice: Subject to any disclaimer, the term of this patent is extended or adjusted under 35 U.S.C. 154(b) by 756 days.

(21) Appl. No.: 11/020,723

(22) Filed: Dec. 23, 2004

(65) Prior Publication Data

US 2006/0138188 A1 Jun. 29, 2006

(51) Int. Cl.
*A45C 15/00* (2006.01)
*A45F 3/04* (2006.01)

(52) U.S. Cl. ..... 224/581; 224/631; 224/637; 224/647; 224/648

(58) Field of Classification Search ..... 224/581, 224/197, 600, 604, 631, 637, 647, 648, 649, 224/650, 259; 190/108
See application file for complete search history.

(56) References Cited

U.S. PATENT DOCUMENTS

| | | | | |
|---|---|---|---|---|
| 4,428,514 | A | 1/1984 | Elf | |
| 4,518,107 | A | 5/1985 | Amos | |
| 4,693,402 | A * | 9/1987 | Comeau | 224/604 |
| 5,337,934 | A | 8/1994 | Johnson et al. | |
| 5,437,403 | A | 8/1995 | Lemanski | |
| 5,657,917 | A * | 8/1997 | Johnson et al. | 224/582 |
| 5,732,867 | A | 3/1998 | Perkins et al. | |
| 5,799,851 | A | 9/1998 | Wulf et al. | |
| 5,803,332 | A | 9/1998 | Thompson | |
| 5,954,253 | A * | 9/1999 | Swetish | 224/631 |
| 5,975,387 | A | 11/1999 | Gleason et al. | |
| 6,010,051 | A | 1/2000 | Callanan | |
| 6,024,265 | A * | 2/2000 | Clements | 224/630 |
| 6,098,859 | A | 8/2000 | Bortner | |
| 6,164,505 | A | 12/2000 | Holter et al. | |
| 6,179,175 | B1 | 1/2001 | Painter | |
| 6,179,188 | B1 | 1/2001 | Gleason | |
| 6,216,932 | B1 | 4/2001 | Wu | |
| 6,276,584 | B1 | 8/2001 | McLachlan | |
| 6,371,346 | B1 | 4/2002 | Sharma | |
| 6,402,003 | B1 | 6/2002 | Jackson | |
| 2003/0106920 | A1 * | 6/2003 | Sagan | 224/578 |

* cited by examiner

*Primary Examiner*—Nathan J Newhouse
*Assistant Examiner*—Corey N Skurdal

(57) ABSTRACT

A backpack having a harness configured to be secured to the torso of a user, and a movable storage compartment pivotably connected at a first end to a first location on the harness. A second end of the storage compartment is releasably secured to a second location on the harness so that motion of the storage compartment with respect to the harness is restrained. The storage compartment is secured to the harness such that it can be released from a stowed position to a frontal location on the harness that is accessible to the user. With the second end of the storage compartment free from constraint, it can be pivoted about its first end from its stowed position to a frontal position on the user, wherein the frontal position allows access to articles contained in the storage compartment without removing the backpack from the user's body.

18 Claims, 18 Drawing Sheets

DUAL POSITION BACKPACK

BACKGROUND OF THE INVENTION

1. Field of the Invention

The present invention relates generally to methods and devices for carrying articles. More particularly, the invention is directed to devices and methods for carrying articles in a backpack wherein the articles can be accessed without removing the backpack from the wearer's body.

Backpacks have become increasingly popular over the years, especially for travel and recreational activities. Numerous variations of the backpack have been developed for carrying articles such as sporting, camping or hunting gear, clothing, books, food and drink, and other belongings. Backpacks are particularly convenient for activities such as walking, hiking, climbing, biking, camping, skiing, snowboarding, snowshoeing, mountaineering, rock-climbing, hunting, horseback-riding and the like because they free the hands of the user and transfer the load away from the hands, which are easily fatigued. Conventional packs are typically designed to be worn with the carrying compartment on the user's back, because carrying a pack on the front of the user restricts motion and limits the user's activities. Therefore, to gain access to articles contained in the pack, the user must first remove the pack, creating a number of inconveniences for almost any type of activity. Once the pack is removed, at least one hand is required to hold it, leaving only the other hand to open or unzip the pack, access the desired article contained therein, and then juggle the article to zip the pack back up or use the article. Alternatively, the pack must be placed on a stable surface such as a table or the ground to free up a hand to retrieve the article contained within.

For certain activities, the options for accessing objects within the pack are even more cumbersome. For example, skiers, snowboarders, backcountry hikers, etc. may have one or both hands already occupied by carrying ski poles and/or ski gloves or other equipment. Therefore, accessing, using, or consuming an item contained in the pack often requires the user to resort to setting the poles, gloves, and/or backpack down. The above practice is not only burdensome, but when done on a chair lift or on a steep slope, in deep powder or on a windy day, the user risks losing any or all of the set down items. Accordingly, numerous sunglasses, gloves, keys, and other items are lost as a result of the above predicament or lack of proper storage.

Conventional backpacks are also burdensome for skiers or snowboarders because they are not suitable for riding on chairlifts while being worn. When riding on a lift with a backpack, the contents of the pack are susceptible to being crushed against the chair's backrest as the wearer leans back. Additionally, if bulky or numerous items are stored in the pack, the wearer tends to lean forward in the seat, which is not only uncomfortable, but unsafe because it shifts the wearer's center of gravity forward toward the open edge of the chair.

Consequently, there has been a need for a backpack that enables a user access to articles contained therein without removing the pack from the user's body. U.S. Pat. No. 5,779,851 describes a combined day pack/travel pack that has a detachable day pack that may be worn on the front of the user in conjunction with a conventional travel pack on the user's back. While this design allows the user to access articles within the day pack, the pack is unsuitable for many sports activities as the continuous position in front of the wearers torso restricts the wearer's freedom of motion.

U.S. Pat. Nos. 5,337,934, and 5,657,917 attempt to address this problem by providing a carrying device having pouches that can be flipped from a stowed position on a main pack over the user's shoulders to a position at the front of the user. In the above patents, the pouch is retained in the rear position by hook and loop material. While the aforementioned patents disclose a device that does allow the user to access some of the contents of the backpack without removing the pack, the hook and loop material is inadequate for retaining the pouches in their stowed position during physical activity such as skiing or snowboarding, or for retaining larger compartments containing bulky or heavy articles. Because release of the hook-and loop material is facilitated by loading the opposing sections in opposite directions to cause separation, a hook-and-loop fastening is susceptible to unwanted release due to dynamic loading that naturally occurs during typical activity. Therefore, the aforementioned device is not suitable for physical activity, and is especially not suited to provide access to a large compartment carrying much or all of the backpack's contents.

Alternatively, U.S. Pat. No. 5,437,403 discloses a travel pack that slides around the user's body to allow the user to access articles contained therein. The pack has a compartment connected to two straps, the first strap shaped to circumscribe the waist of the user, and the second strap shaped to extend under the arm on one side of the user and over the shoulder of the opposite side of the user. The pack is moved from the back to the front of the user by sliding the compartment under the arm of the user. Because the compartment must slide between the user's side and arm, it is limited to in shape and size to that can comfortably pass through. Additionally, because the compartment is only held by one strap over the shoulder, it is not very stable for highly physical activity.

Additionally, there is a need for a backpack that allows attachment of large equipment such as a pair of skis or a snowboard without compressing the contents of the backpack. U.S. Pat. No. 5,803,332 is a typical backpack having straps for attaching and carrying large equipment. However, this pack requires that the equipment be strapped to the outside panel of the pack, which is generally less stable than the inner panel adjacent to the wearer's back, and also tends to crush any other articles that may be inside the pack.

In view of the foregoing, it would be desirable to provide a convertible backpack that enables a user to access articles contained in the backpack while the backpack is worn on the person. In particular, it would be desirable to provide a convertible backpack that enables a user to move a storage compartment from the user's back to a position at the front of the user without requiring that the backpack be removed or pulled off of the user. Moreover, it would also be desirable to provide a convertible backpack that enables a user to move a carrying compartment from the front of the user to a position on the back of the user and securely retain the compartment in the aft position during high impact activity without motion relative to the user. It would further be desirable to provide a convertible backpack that is capable of holding equipment such as a shovel, snowboard or pair of skis to a panel adjacent to the user's back and between the panel and a storage compartment having articles therein. At least some of these objectives will be met by the present invention.

2. Description of the Background Art

U.S. Pat. Nos. 5,337,934, 5,437,403, 5,657,917, 5,779,851, and 5,803,332 have been described above. Other patents of interest include U.S. Pat. Nos. 4,428,514, 4,518,107, 6,010,051, 6,179,175, 6,216,932, and 6,402,003.

BRIEF SUMMARY OF THE INVENTION

The present invention provides an improved apparatus for carrying articles in a backpack so that the articles may be accessed by the user without having to remove the pack from the body.

Although the following description will focus on embodiments configured for high activity sports such as skiing or snowboarding, other embodiments may be used to in a variety of applications. In particular, the carrying devices and methods of the present invention may be used whenever access to articles contained in the backpack pack is desired without having to remove the pack from the wearer's body. Therefore, the following description is provided for exemplary purposes and should not be construed to limit the scope of the invention.

In a first aspect of the present invention, a backpack comprises a harness having a waist belt and left and right shoulder straps, and a movable storage compartment pivotably connected at a first end to a first location on the harness. A second end of the storage compartment is releasably secured to a second location on the harness so that motion of the storage compartment with respect to the harness is restrained. With the second end of the storage compartment free from constraint, it can be pivoted about its first end from its stowed position to a frontal position on the user, wherein the frontal position allows access to articles contained in the storage compartment without removing the backpack from the user's body.

In another aspect of the present invention, a backpack comprises a harness configured to securedly attach to a person's torso, and a movable storage compartment having a first portion and a second portion. The backpack also includes a pivotable connection pivotally connecting the first portion of the movable compartment to a first location on the harness to allow reorientation of the movable compartment from a stowed position to a frontal position on the user. The backpack further includes a releasable connection releasably connecting the second portion of the movable compartment to a second location on the harness, such that motion of the movable compartment with respect to the harness is substantially locked in the stowed position when the releasable connection is engaged. The releasable connection is further configured to disengage so that the movable compartment may be reoriented from the stowed position to a frontal position on the user.

In a preferred embodiment, the storage compartment comprises one or more openings so that articles located inside the storage compartment can be accessed from either the stowed or frontal position. The one or more openings may be enclosed by zippers, buttons, hook and loop material, etc. located at the front and/or the rear of the storage compartment.

In another preferred embodiment, the harness has a waist belt, left and right shoulder straps, and a support panel, the support panel having a back wall adjacent to the person's back and a front wall adjacent to the storage compartment when in the stowed position, an upper section attached to a first end of each of the left and right shoulder straps, and a lower section attached to a second end of the left and right shoulder straps, wherein the waist belt is affixed to the lower section of the support panel.

In many cases, the support panel has a stiffening means so that the back wall rigidly conforms to the contours of the user's back. The stiffening means may comprise a generally planar piece of semi-rigid material, such as a polymer, plastic, condensed foam, etc, that is interposed between the back and front walls of the support panel. Ideally, the stiffening means is rigid enough to provide stability to the harness, yet flexible enough to conform to the contours of the user's back. The support panel may also comprise padding on the back wall adjacent to the user's back so that heavy loads may be comfortably carried in the backpack. In some embodiments, the support panel also has a recess interposed between the front and back walls of the support panel to accommodate additional storage. For example, a recess may be sized to accommodate a hydration bladder between the front and back walls of the support panel.

In some embodiments, the backpack further comprises an anti-sliding means to inhibit lateral motion between the storage compartment and the harness. Often, the anti-sliding means comprises first and second sections of material having a high coefficients of friction, wherein the first section of material is positioned on the front wall of the support panel, and the second section of material is positioned on the back wall of the storage compartment so that it opposes the first section of material when the storage compartment is in the stowed position. The front wall of the support panel may also comprise one or more holding straps to carry an elongate article.

In one mode of the current invention, the pivotable connection comprises first and second pivotable connections laterally spaced apart at an upper section of the harness, wherein the first end of the movable compartment is located at an upper section of the movable compartment, and the second end of the movable compartment is located at a lower section of the movable compartment. The upper section of the movable compartment is pivotably connected via first and second pivotable connections on the left and right shoulder straps, and the lower section of the movable compartment is releasably fastened to the waist belt at a location accessible to the user while wearing the backpack.

In one variation, the upper section of the storage compartment has a recess between the first and second pivotable connections on the left and right shoulder straps to provide clearance for the storage compartment as it is rotated from the stowed position to the frontal position on the user.

In an alternative embodiment, the mavable compartment may further comprise left and right rotation straps, wherein the left rotation strap is connected at a first end to the upper section of the movable compartment, and pivotally connected at a second end to the left shoulder strap, and the right rotation strap connected at a first end to the upper section of the movable compartment In some embodiments the storage compartment is releasably attached to the left and right shoulder straps so that it can be carried separately independent of the harness as a handbag. In cases where the rotation straps are used, the rotation straps may be releasably connected to the shoulder straps, the storage compartment, or both. The left and right shoulder straps may also comprise a plurality of attachment points for releasably attaching the storage compartment. For example, the plurality of attachment points comprise receiving slots for one or more loops. Optionally, the storage compartment may further comprise a latching member that releasably attaches to the one of the loops or slots on each shoulder strap.

In one alternative variation, the first and second pivotable connections are configured to slideably translate along the left and right shoulder straps when the second end of the movable compartment is in a disengaged configuration to allow motion.

In one mode of the present invention, the releasable connection comprises first and second releasable connections laterally spaced apart at a lower section of the harness. Preferably, the releasable connections are on opposing sides of the waist belt at a frontal location accessible to the user.

In one embodiment of the current mode, the backpack further includes left and right support straps. The left support strap is fixed at a first end to a left side of the lower section of the movable compartment, and the right support strap is fixed at a first end to a right side of the lower section of the movable compartment. The left support strap is connected to the waist belt via the first releasable connection and the right support strap is connected to the waist belt via the second releasable connection.

In some embodiments, the backpack further comprises a tightening means coupling the movable compartment to the harness, the tightening means compressing the movable compartment onto the harness. Generally, the tightening means is disposed between the lower section of the movable compartment or support strap and the releaseable connection or harness.

In some embodiments, the releasable connection comprises a quick release buckle releasably fastening the support strap to the waist belt. Alternatively, a ratchet assembly releasably fastens the support strap to the waist belt, the ratchet assembly comprising a serrated strap and a ratcheting buckle. As another alternative, a latch assembly may be used to releasably fasten the support strap to the waist belt, wherein the latch assembly comprises a tongue and latch having interlocking surfaces that can be released by depressing a lever arm on the latch.

In another mode of the current aspect, the backpack further comprises a lower movable compartment and a sternum strap, wherein the lower storage compartment is fixed to the harness adjacent to and below the movable storage compartment. In this configuration the movable storage compartment may be pivotably connected at its upper end to a location on the left and right shoulder straps, and releasably fastened to a second location on the left and right shoulder straps. The sternum strap may also be used in any of the embodiments of the invention to retain the shoulder straps from sliding outward on the person's shoulders.

In a further aspect, a backpack comprise a movable compartment and a harness having a waist belt, left and right shoulder straps, and a support panel with a back wall configured to be secured adjacent to a person's back, and a front wall spaced apart from the person's back. The movable compartment is pivotably connected at a first end to a first section of the harness, and a second end of the movable compartment is releasably fastened to a second section of the harness. The movable compartment is secured to the harness in a stowed position adjacent to the front panel of the harness to restrain motion of the movable compartment with respect to the harness until the second end of the movable compartment is released from the harness. Upon release, the movable compartment is configured to be pivoted about its first end from the stowed position to a frontal position on the person.

In one mode of the current aspect, the movable compartment has an inner wall and an outer wall one or more pieces of equipment may be mounted between the front wall of the harness and the inner wall of the storage compartment. For example, one or more holding straps may be attached to the outer wall of the support panel so that an elongate article may be fastened between the harness and the storage compartment.

In one embodiment, the harness further comprises an upper section attached to a first end of each of the left and right shoulder straps, and a lower section attached to a second end of the left and right shoulder straps, wherein the waist belt is affixed to the lower section of the harness. The first end of the movable compartment is pivotably connected at two laterally spaced apart locations on the upper section of the harness, and a second end of the of the movable compartment is releasably fastened at two laterally spaced apart locations on the waist belt.

In another aspect of the invention, a backpack comprises a harness configured to be secured on a person's torso and a movable compartment configured to be received on said harness. The backpack further includes a pivotable connection pivotally connecting a first end of the movable compartment to a first location on the harness, and means to releasably fasten a second end of the movable compartment to a second location on the harness such that the movable compartment is restrained in a stowed position. Upon release of the second end of the movable compartment from the harness, the movable compartment is adapted to be manually rotated about the first location on the harness to a frontal position on the person.

Preferably, releasable fastening means is accessible to the person while the backpack is secured to the person's torso. The backpack may also include an adjustment means coupling the movable compartment with the harness, the adjustment means allowing the movable compartment to be tightened to the harness. In addition, a stiffening means coupled to the movable compartment, wherein the stiffening means retaining alignment of the movable compartment with the harness.

In another embodiment of the invention, a method of fabricating a backpack having a compartment accessible from a front and back of a user comprises: pivotably connecting a first section of a storage compartment to a first position on a harness; and releasably fastening a second section of the of the storage compartment to a second position on the harness; wherein the storage compartment is secured to the harness in a stowed position so that motion of the storage compartment with respect to the harness is restrained, and wherein the storage compartment may be pivoted about its first end from its stowed position to a frontal position on the user so that articles contained in the storage compartment may be accessed without removing the backpack from the user's body.

In another embodiment of the invention, method of accessing articles in a backpack while the backpack is worn on a user, comprises: placing a backpack on a user, the backpack having a storage compartment and a harness, the harness having a waist belt and left and right shoulder straps; fastening the waist belt to the user; releasing a lower section of the storage compartment from a secure position on the harness, wherein the storage compartment is released at a location at the front of the harness that is accessible to the user; rotating the storage compartment from the stowed position at the back of the user over the shoulder straps to a frontal position on the user; and opening the storage compartment to gain access to the articles contained therein. The support panel typically has a back wall adjacent to the user's back, and a front wall spaced apart from the user's back, and may also comprise holding straps for carrying an elongate article on the front wall of the support panel.

Further aspects of the invention will be brought out in the following portions of the specification, wherein the detailed description is for the purpose of fully disclosing preferred embodiments of the invention without placing limitations thereon.

DETAILED DESCRIPTION OF THE INVENTION

In the following description, various aspects of the invention will be described. For purposes of explanation, specific configurations and details are set forth in order to provide a thorough understanding of the present invention. However, it will also be apparent to one skilled in the art that the present invention may be practiced without the specific details herein. Furthermore, well known features may be omitted or simplified in order not to obscure the present invention.

Embodiments of the present invention relate to apparatus and methods for carrying articles on the front or back of a user. The device comprises a backpack having a harness and a movable storage compartment that is able to pivot interchangeably from the back and front of the user.

Figure 1A:
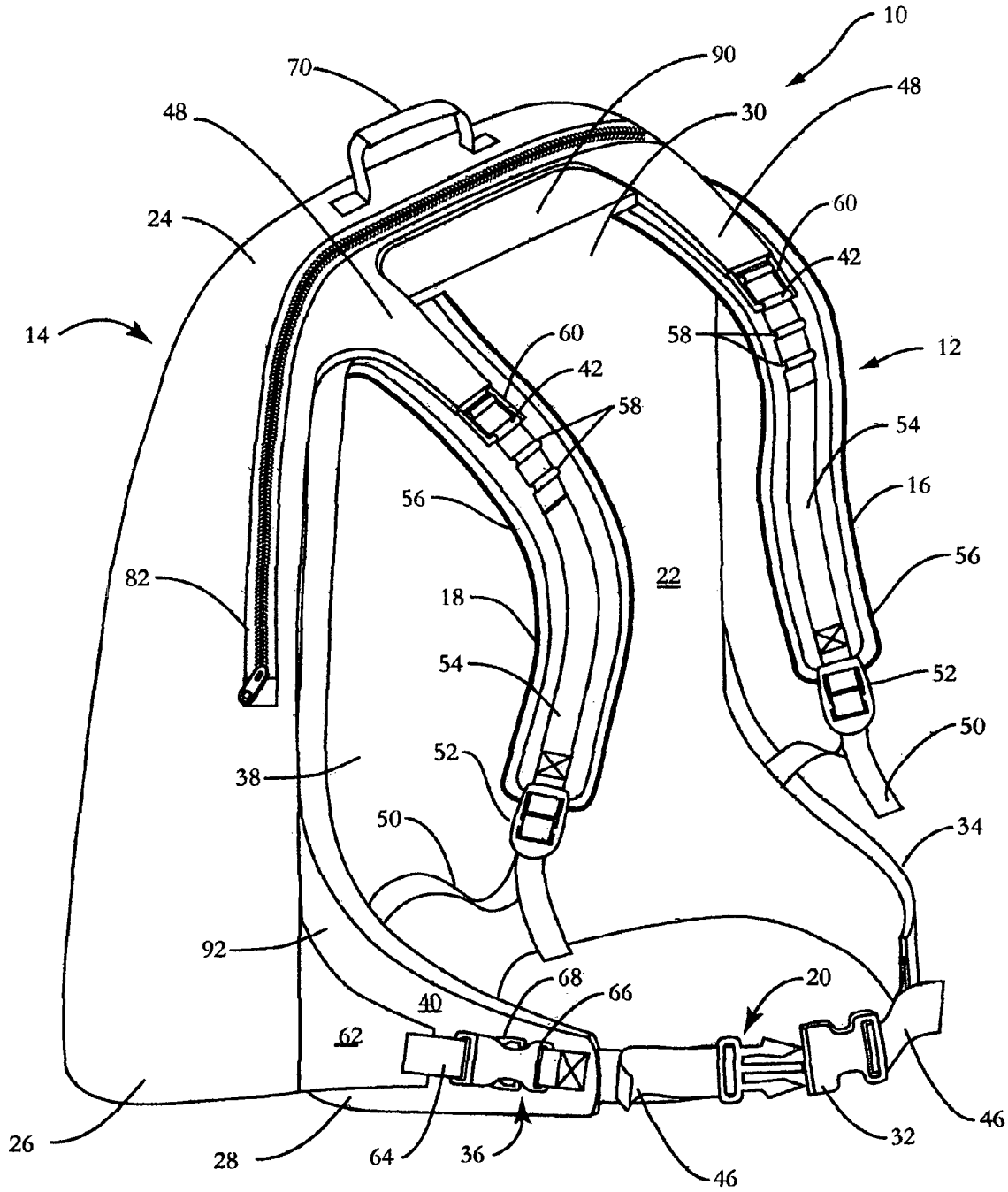
FIG. 1A is a perspective view of a backpack having a movable storage compartment in accordance with the present invention.

Reference is now made to FIG. 1A, which is a schematic illustration of the backpack 10 in accordance with the embodiments of the invention. The backpack 10 includes a harness 12, and a movable storage compartment 14 for carrying articles. The harness 12 has a left shoulder strap 16, right shoulder strap 18, support panel 22, and a hip or waist belt 20. The left shoulder strap 16 and right shoulder strap 18 are connected at their ends to the top section 30 and bottom section 28 of support panel 22. The left and right shoulder straps generally comprise padded shoulder sections 56 and shoulder webbing straps 50. The padded shoulder sections 56 each having mounting straps 54 sewn to the top surface and running along the length of the padded section 56. The left and right shoulder straps 16, 18 may further comprise strap-lock buckles 52, which connect one end of the mounting straps 54 with the shoulder webbing straps 50 so that the length of shoulder webbing straps 50 may be adjusted.

Figure 11:
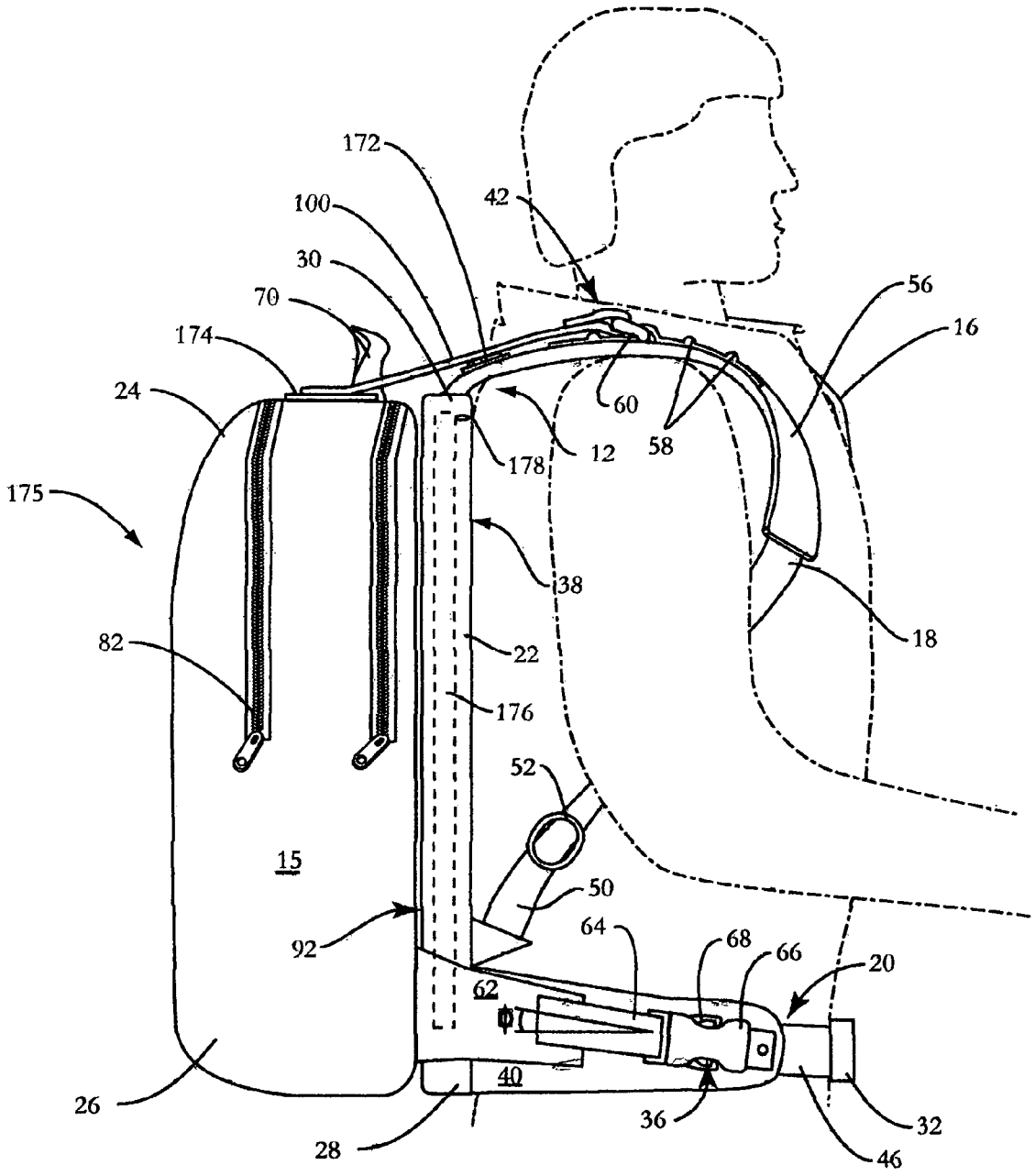
FIG. 11 is an alternative embodiment of the invention having rotation straps to connect the movable compartment to the harness.

Typically, the waist belt 20 is connected to opposite ends of the bottom section 28 of the support panel 22. The waist bet 20 generally comprises waist adjustment straps 46 and a quick-release buckle 32 for adjustably securing the bottom end of the backpack 10 around the users waist. Buckle 32 may include a variety of different fasteners known in the art, including a side release buckle, center release buckle, cam buckle or the like. Waist adjustment straps 46, webbing straps 50, and mounting straps 54 may comprise any flexible webbing material such as nylon, cotton, polyester or the like. The waist belt 20 also may have and left and right padded sections 34, 40 that extend from the back of the user to the side or front of the user when the user is wearing the backpack. Left and right padded sections 34, 40 may be continuous extensions of support panel 22, as shown in FIG. 1A, or a separate padded belt that is attached to the back wall 38 of support panel 22 as illustrated in FIG. 11.

In many embodiments, movable storage compartment 14 is pivotably connected at its upper section 24 to a top section 30 of the harness 12 by two pivotable connections 42. Pivotable connections 42 are preferably located on the top of the left and right shoulder straps 16, 18, but may also be placed on the top section 30 of the support panel 22. The lower section 26 of the movable storage compartment 14 is releasably connected to one or more locations on the bottom section 28 of the harness 12. Releasable connection 36 is generally located at a frontal or side position on the waist belt 20, and preferably on the foremost sections of the left and right padded sections 34, 40. Movable storage compartment 14 further comprises at least one closeable opening 82, which allows access to the interior of the storage compartment. Closeable opening 82 preferably comprises a zipper, but may also comprise buttons, snaps, hook and loop material, or other closure means. The movable compartment 14 preferably comprises a high denier fabric such as nylon, but may also comprise any lightweight but strong and flexible material or fabric.

Figure 12:
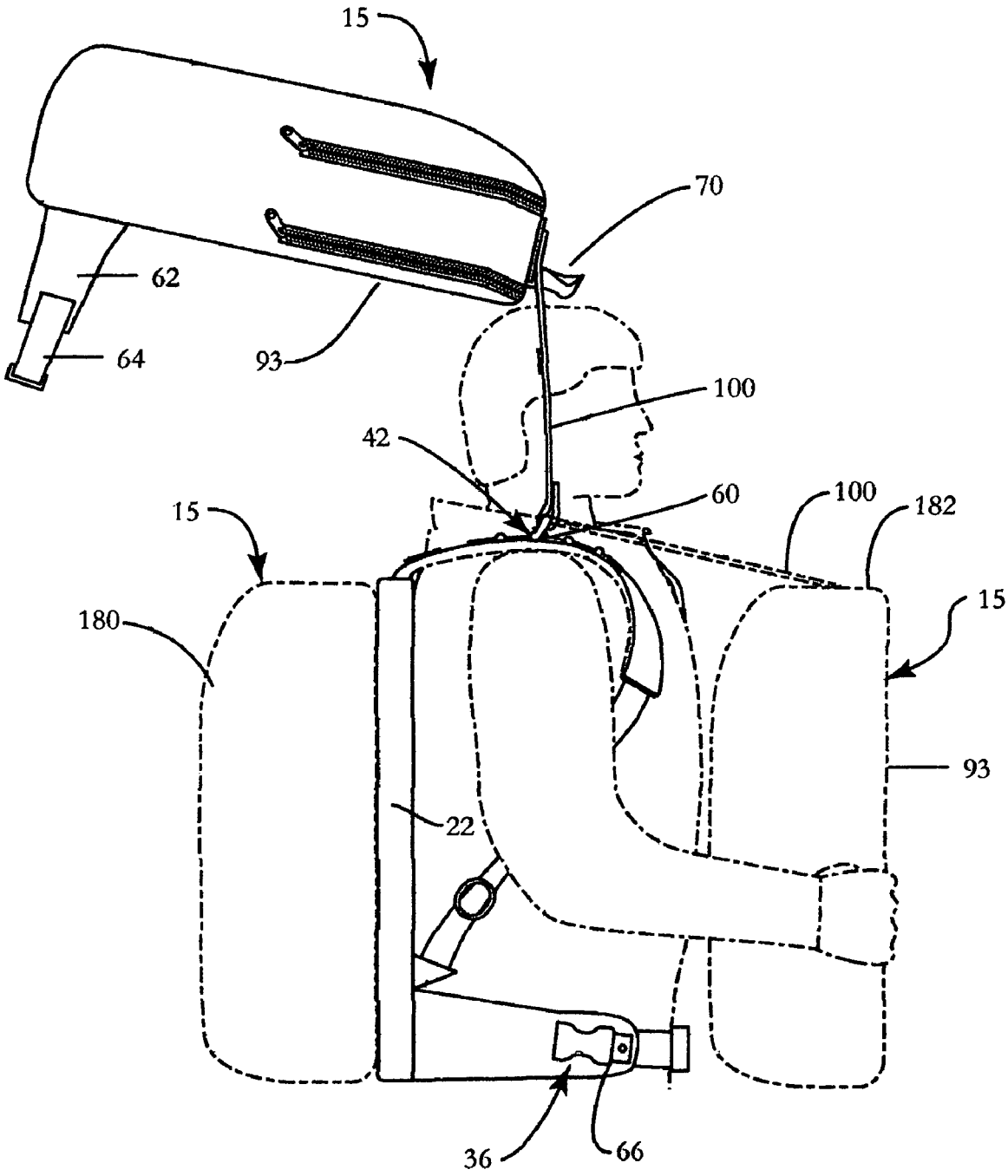
FIG. 12 illustrates an embodiment of the invention being rotate from the back of the user to the front of the user.

In one method of the present invention, the backpack 10 is secured to a user by fastening the waistbelt to the user. The lower section 26 of the movable compartment 14 is released from the bottom section 28 of the harness 22 by disengaging releasable connection 36, which is accessible by hand from the front of the user. As seen in FIG. 12, the movable compartment 14 may then be rotated about pivotable connection 42 from the stowed position at the back of the user, over the shoulder straps 16, 18, to a frontal position on the user. To rotate the movable compartment, the user may pull up on compression strap 64, support strap 62, male connector 68, or a combination thereof to lift and rotate the movable compartment over the head of the user. Alternatively, the user can reach back and pull on handle 70 to rotate the movable compartment to the user's torso. Once positioned at the front of the user, the opening 82 of movable compartment 14 may then be opened to gain access to the articles contained therein.

Figure 1B:
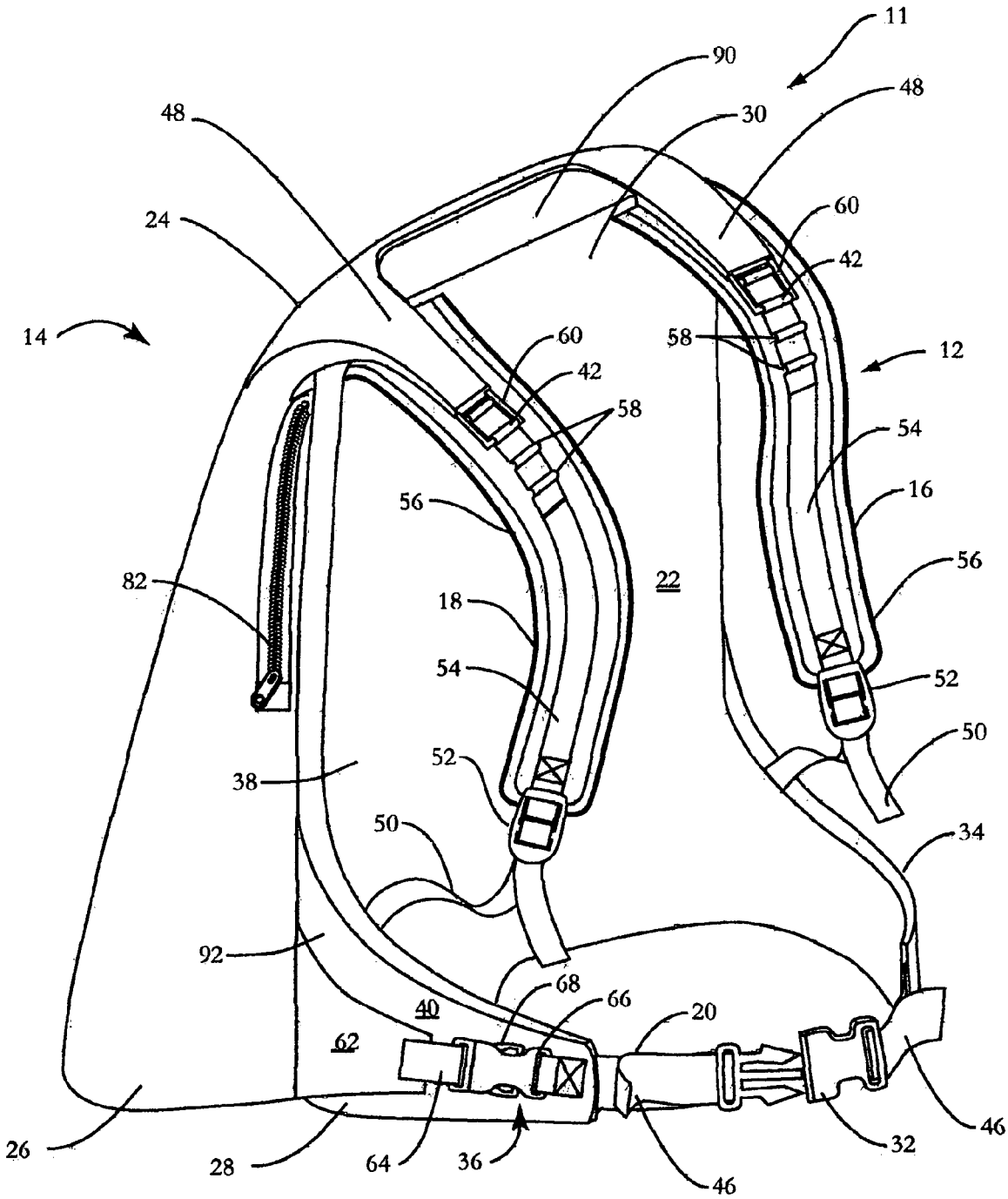
FIG. 1B is a perspective view of a backpack having a teardrop shaped movable storage compartment in accordance with the present invention.

Referring now to FIG. 1B, backpack 11 has a teardrop-shaped movable compartment 14 that tapers at the upper section 24. Zipper 82 crosses over to back wall 93 prior to the interface of u-shaped profile 48. In this configuration, the zipper 82 is in an outermost position when the movable compartment 14 is rotated to the front of the user, thereby allowing easy access to the user.

In many embodiments, the upper section 24 of movable compartment 14 may have a U-shaped profile 48 for pivotably connecting the movable compartment. The U-shape connection allows the main compartment clearance to pass over the head of the user as the compartment is rotated from the stowed to frontal position. Alternatively, the upper section 24 of the movable compartment may be pivotably connected to the shoulder straps 16, 18 by left and right rotation straps 100, as illustrated in FIGS. 11 and 12.

Referring now to FIGS. 6A to 7B, the pivotable connections 42 may comprise any rotatatable connection known in the art, for example: a hinge, bushing, ball bearing, roller bearing, thrust bearing or the like. In one embodiment, mounting straps 54 that are sewn into the top surface of shoulder straps 16, 18 so that one or more rotation housings 58 are positioned along the shoulder straps. Housings 58 are shaped to house a fastening loop 60. Fastening loop 60 may comprise a solid loop, caribiner, or an adjustable C-ring as shown in FIG. 7A and described in further detail below. Housings 58 may be sized to provide a snug fit with fastening loop 60 so that there is little or no play between the loop and the shoulder strap, but still allows rotation of the compartment about the shoulder strap. Little or no lateral or side-to-side motion between the harness 22 and the movable compartment 14 not only stabilizes the compartment during movement, but also allows for repeatable alignment of the lower section 26 of compartment 14 with releasable connection 36.

Figure 6A:
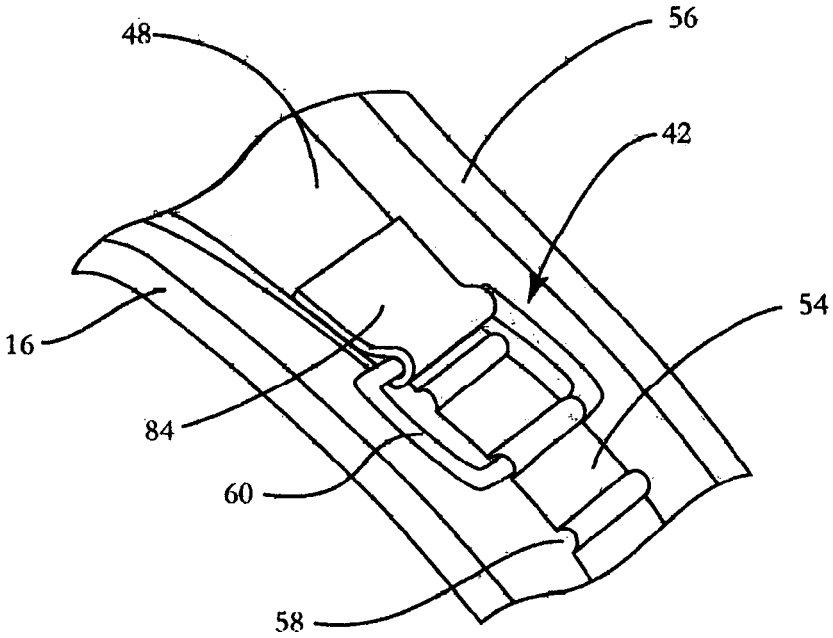
FIG. 6A illustrates a perspective view of a pivotable connection using a loop in accordance with the present invention
Figure 6B:
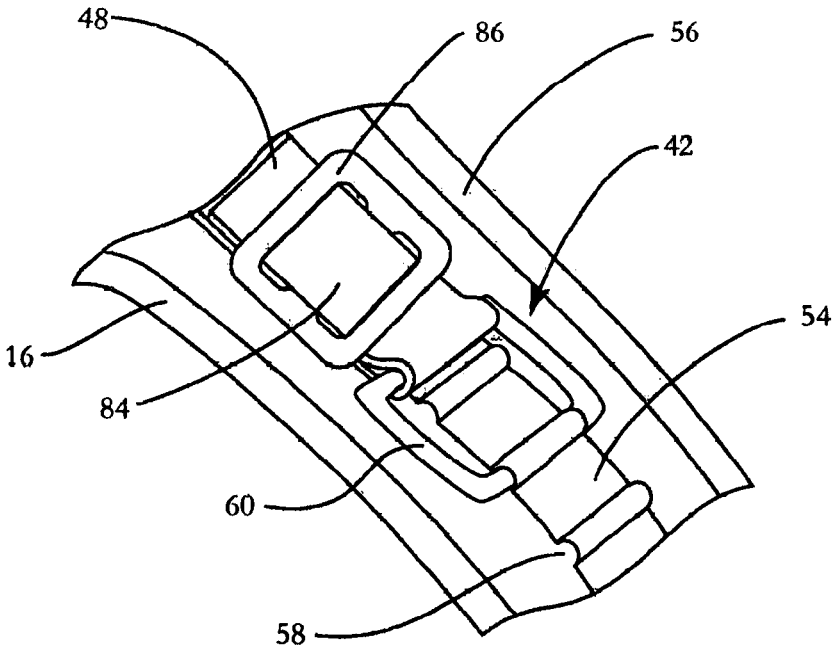
FIG. 6B is another embodiment of a pivotable connection using a loop and slider in accordance with the present invention.

Referring to FIG. 6A, fastening loop 60 comprises a rectangular loop housed at one end inside bearing 58 and connected at another end to end section 84 of profile 48. End section 84 may comprise a flexible material such as nylon fabric or webbing that is wrapped around the free side of loop 60 and is fastened back on to itself to encase the free side of loop 60. In such a case, end section may be fastened to itself by stitching, opposing pieces of hook-and loop material, rivets, buttons, snaps or the like. Loop 60 may also be combined with slider 86 such that slider 86 cinches down the two sides of end section 84 on to encase the loop 60, as illustrated in FIG. 6B. The fabric or webbing material of end section 84 may also have a stiffening member (not shown) that is flexible in one direction (bending), but is rigid in torsion and lateral directions so that the movable compartment 14 maintains alignment with releasable connection 36. Where mounting strap 54 is permanently fixed or sewn into padded shoulder section 56, multiple loops 60 may be encased into bushings 58.

Alternatively, end section 48 may comprise a semi-rigid material, such as plastic or a thin sheet of metal that is permanently folded over on to itself to provide a housing for loop 60. In this configuration, the end section material is flexible enough to allow the loop to be snapped into place, yet resilient enough to return to its folded-over configuration and retain the loop 60 in its housing.

Figure 7A:
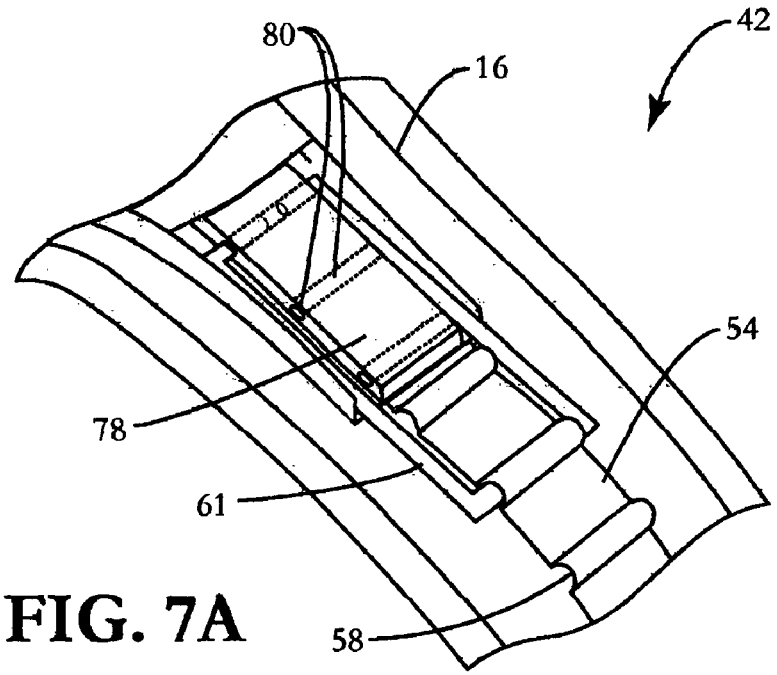
FIG. 7A illustrates another embodiment of a pivotable connection using a c-ring in accordance with the present invention.

Referring to FIG. 7A, fastening loop 61 comprises a C-ring that allows for adjustment of the length of U-shaped profile 48 to vary the clearance provided by the U-shaped profile. Where multiple bearings 58 are provided, the fastening loop 60 may be reinserted into a particular bearing 58 along the shoulder strap to compensate for the increased or decreased profile 48 and maintain the position of the main compartment with respect to the harness support panel. Each flange of the U-profile 48 may comprise a slotted insert 78 having a plurality of peg-holes 80 for adjustably fastening the C-ring to the movable compartment.

Figure 7B:
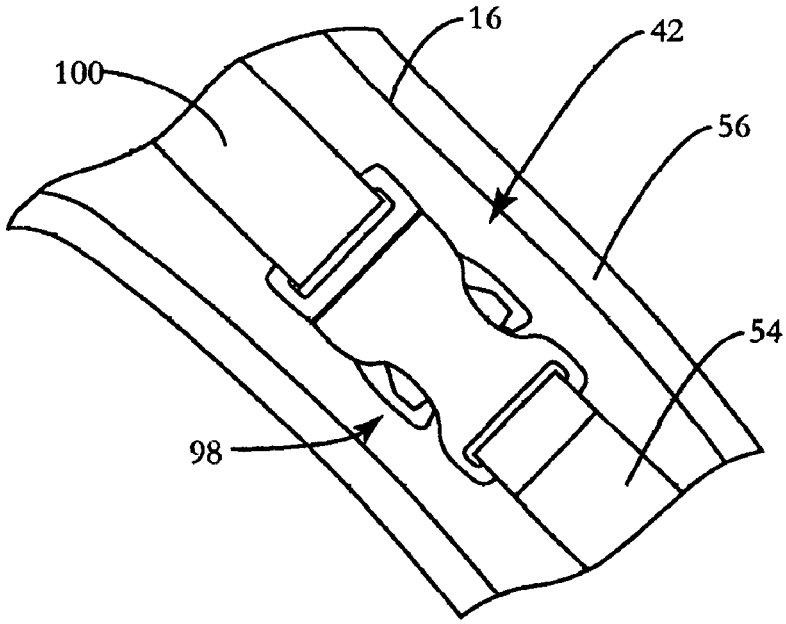
FIG. 7B shows yet another embodiment of a pivotable connection using a side-release buckle in accordance with the present invention.

In another embodiment shown in FIG. 7B, pivotable connection may comprise a quick release buckle 98 fastened at one end to mounting strap 54 and at a second end to rotation strap 100 or end section 84 (not shown). Mounting strap 54 is preferable fixed or sewn to padded shoulder section 56 up to the buckle 98 to limit lateral motion of buckle 98. This configuration allows for quick and full detachment of the movable compartment 14 from the harness 22. Alternatively, for a permanent pivotable connection 42, the buckle may be forgone and the rotation strap 100 may be integral with or sewn to the mounting strap 54 that is sewn into the shoulder strap.

Figure 7C:
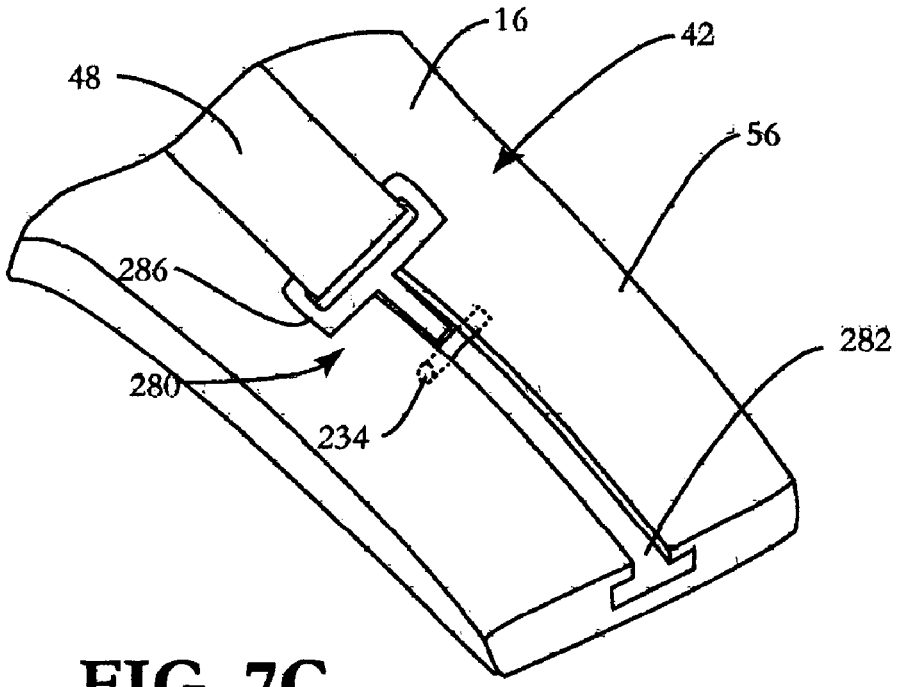
FIG. 7C shows yet another embodiment of a pivotable connection that is configured to slideably translate along the shoulder straps.
Figure 7D:
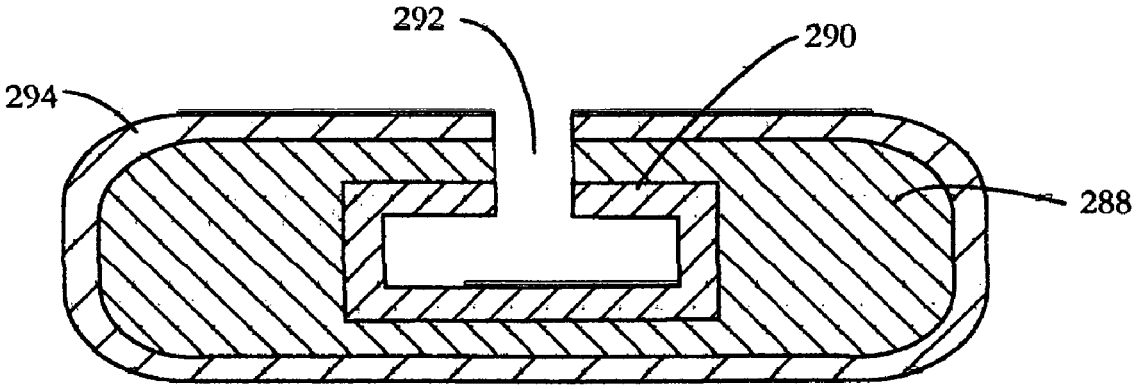
FIG. 7D shows a cross section view of the embodiment of FIG. 7*c*.

Now referring to FIG. 7C, pivotable connection 42 may also be configured to translate along the shoulder straps 16, 18 to allow for additional clearance when rotating the movable compartment from the stowed orientation. Pivotable connection 42 may comprise a T-shaped connector 280 having a loop 286 for securing rotation strap 100 or profile 48. Connector 280 has a T-shaped engagement arm 284 sized to interface with c-shaped grove 282 that is embedded into and runs along the shoulder strap. As seen in a cross-section of the shoulder strap 16 in FIG. 7D, channel 282 may be formed by channel member 290 having a C-shaped cross section. Channel member 290 preferably comprises an extruded, flexible material, such as plastic, and is surrounded by padding 288 except at the upper extremity to leave a slot 292 so that the connector 280 is free to translate down the shoulder strap. The shoulder strap may further comprise nylon cover 294 the is sewn or glued to padding 288. In this configuration, pivotable connection 42 is allowed to translate from a location near the back of the user, to a location more forward, thus giving more clearance for the movable compartment as it is rotated over the user's head.

Figure 2:
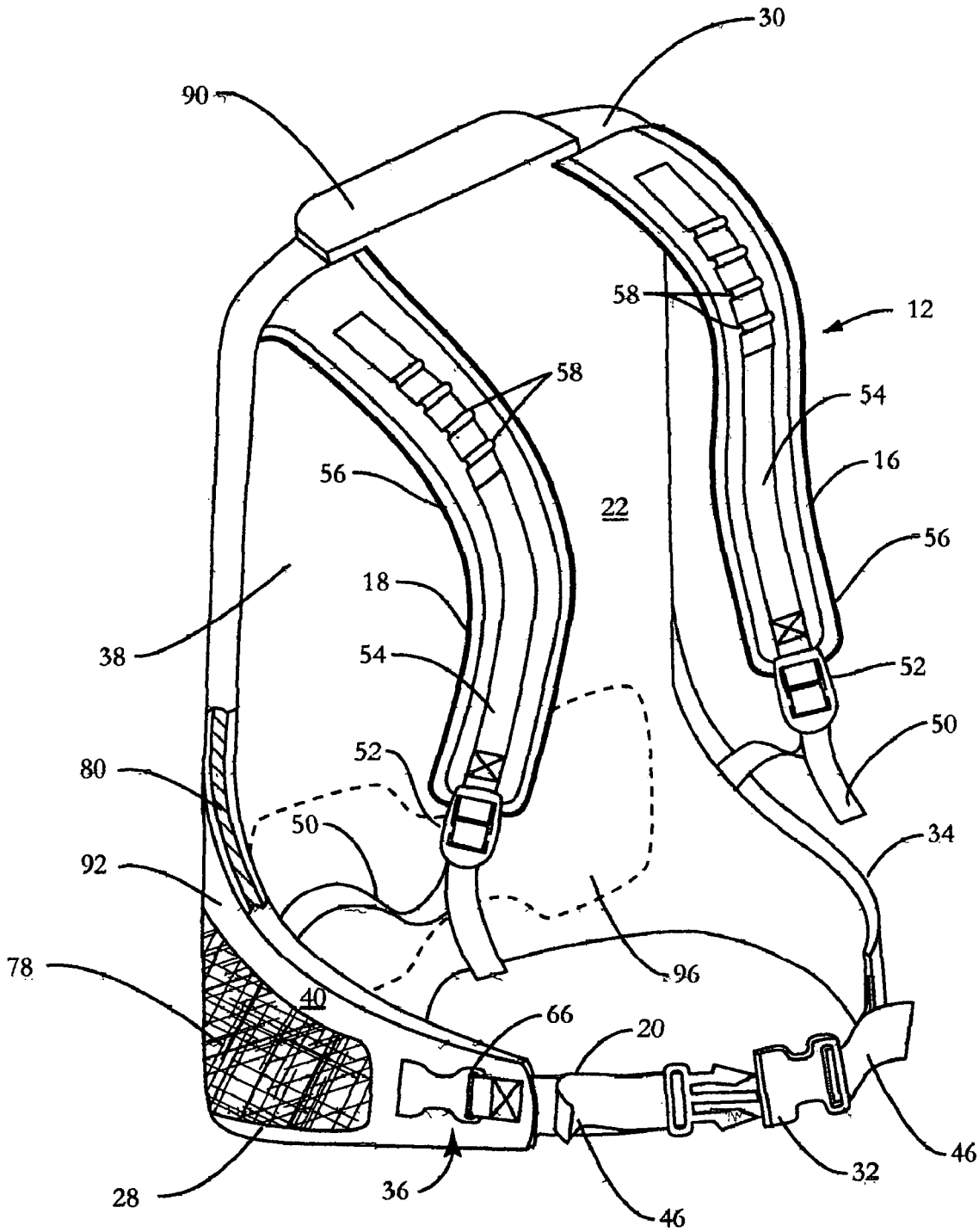
FIG. 2 is a perspective view of an exemplary harness for a backpack of the present invention.
Figure 3:
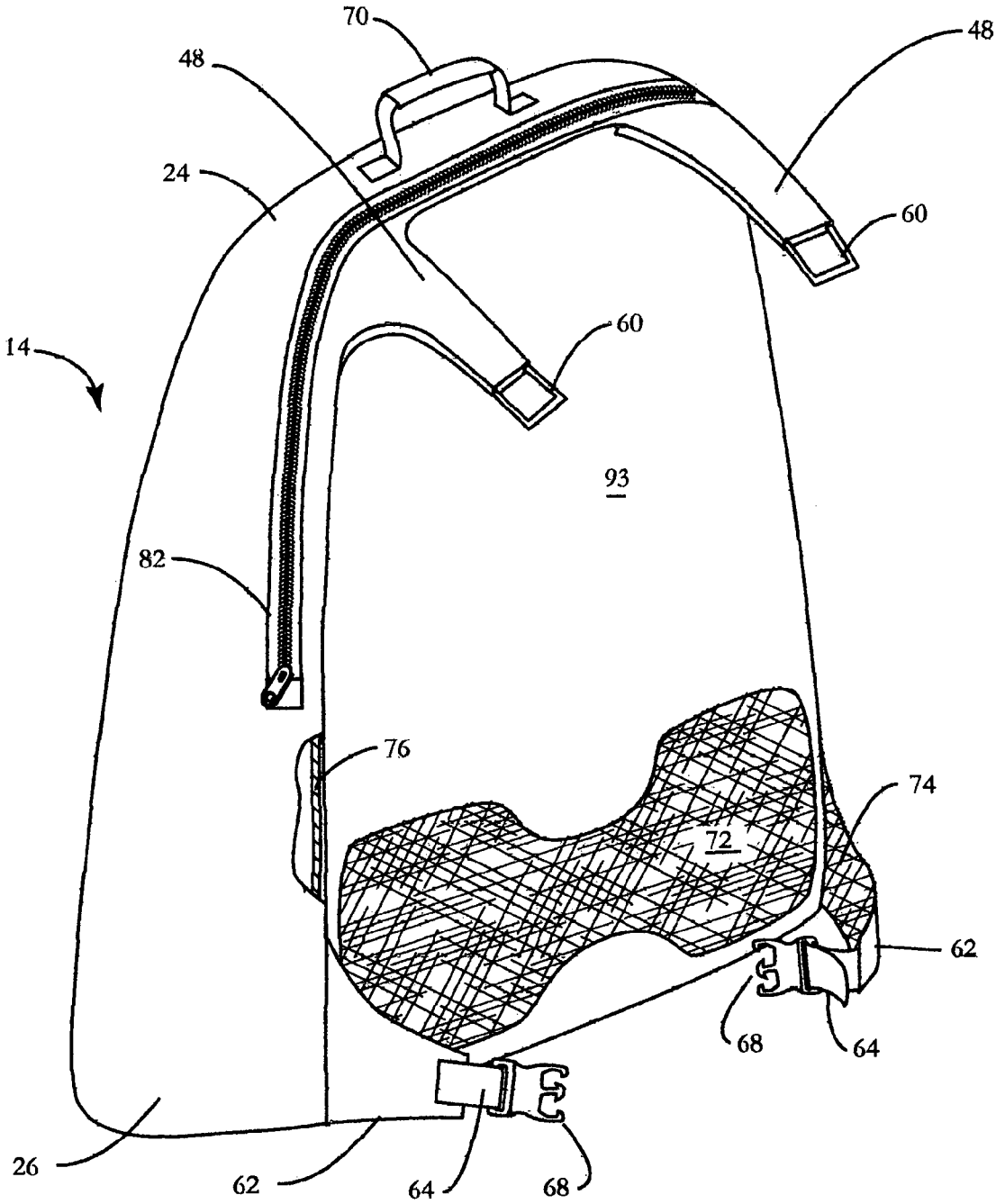
FIG. 3 is a perspective view of an exemplary movable storage compartment for a backpack of the present invention.
Figure 5:
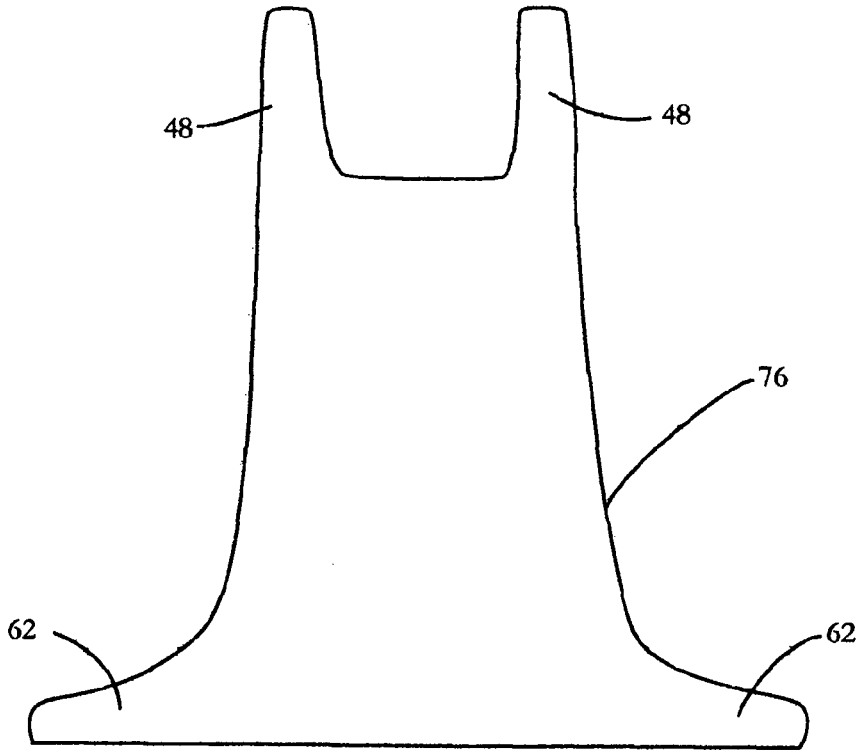
FIG. 5 is a rear view of a stiffening panel for a movable storage compartment in accordance with the present invention

In some embodiments, the movable compartment 14 and support panel 22 may have stiffening means such as compacted foam or a plastic stiffening panel 76 or 80 to keep the movable compartment and support panel from buckling or unduly bending. The stiffening means may comprise a generally planar piece of semi-rigid material, such as a polymer, plastic, condensed foam, etc, that is interposed between the back and front walls of the support panel. Ideally, the stiffening means is rigid enough to provide stability to the harness, yet flexible enough to conform to the contours of the user's back. The support panel may also comprise padding on the back wall adjacent to the user's back so that heavy loads may be comfortably carried in the backpack. As shown in FIG. 2, stiffening panel 80 may be disposed between the back wall 38 and the front wall 92 of the support panel and extend to hip pads 40 and 34. Movable compartment stiffening panel 76 may be disposed behind back wall 93, as shown in FIG. 3. The stiffening panel 76 may comprise a single sheet of material and extend to form the U-shaped section 48 and support straps 62, as illustrated in FIG. 5.

Figure 4:
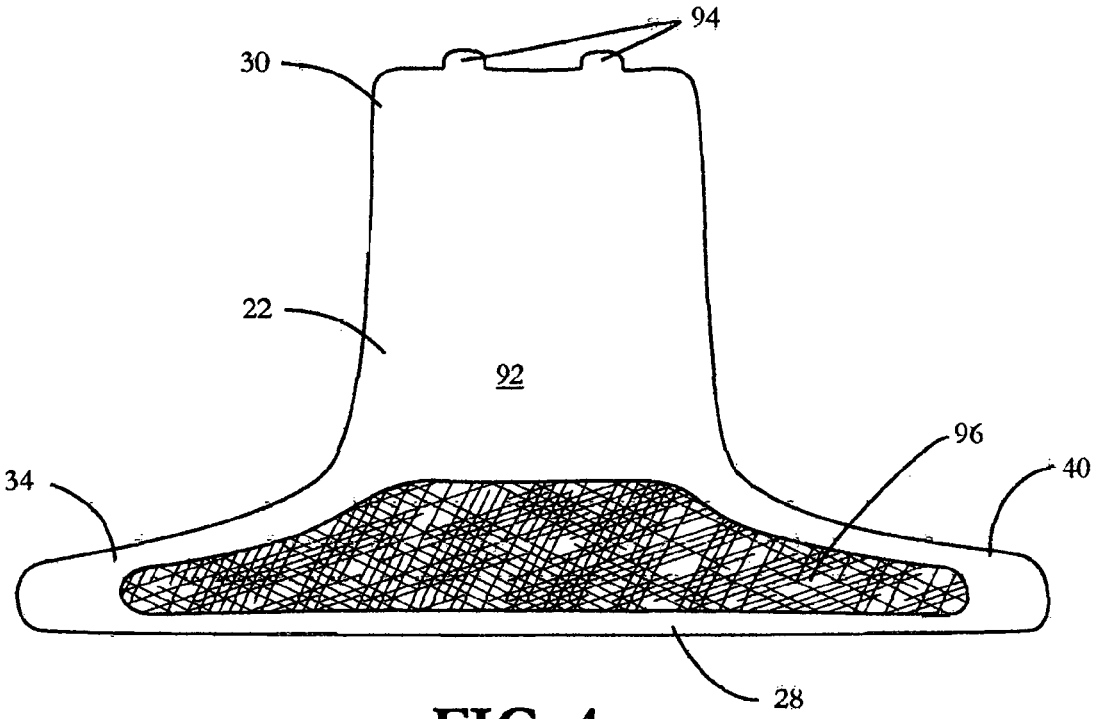
FIG. 4 is a rear view of a support panel of the harness in accordance with the present invention.

Referring to FIGS. 2-4, the front wall 92 of support panel 22 and the back wall 93 of the movable compartment may have mating motion inhibitor patches 96 and 72 having a high coefficient of friction to retain the movable compartment from laterally sliding in relation to the harness. Motion inhibiting material 74 and 78 may also be located on the hip belt pads 40, 34 and mating surfaces on support straps 62. Alternatively, motion inhibiting patch 96 may extend across the bottom end of the support panel across to the hip belt pads 34, 40, as illustrated in FIG. 4.

Figure 13:
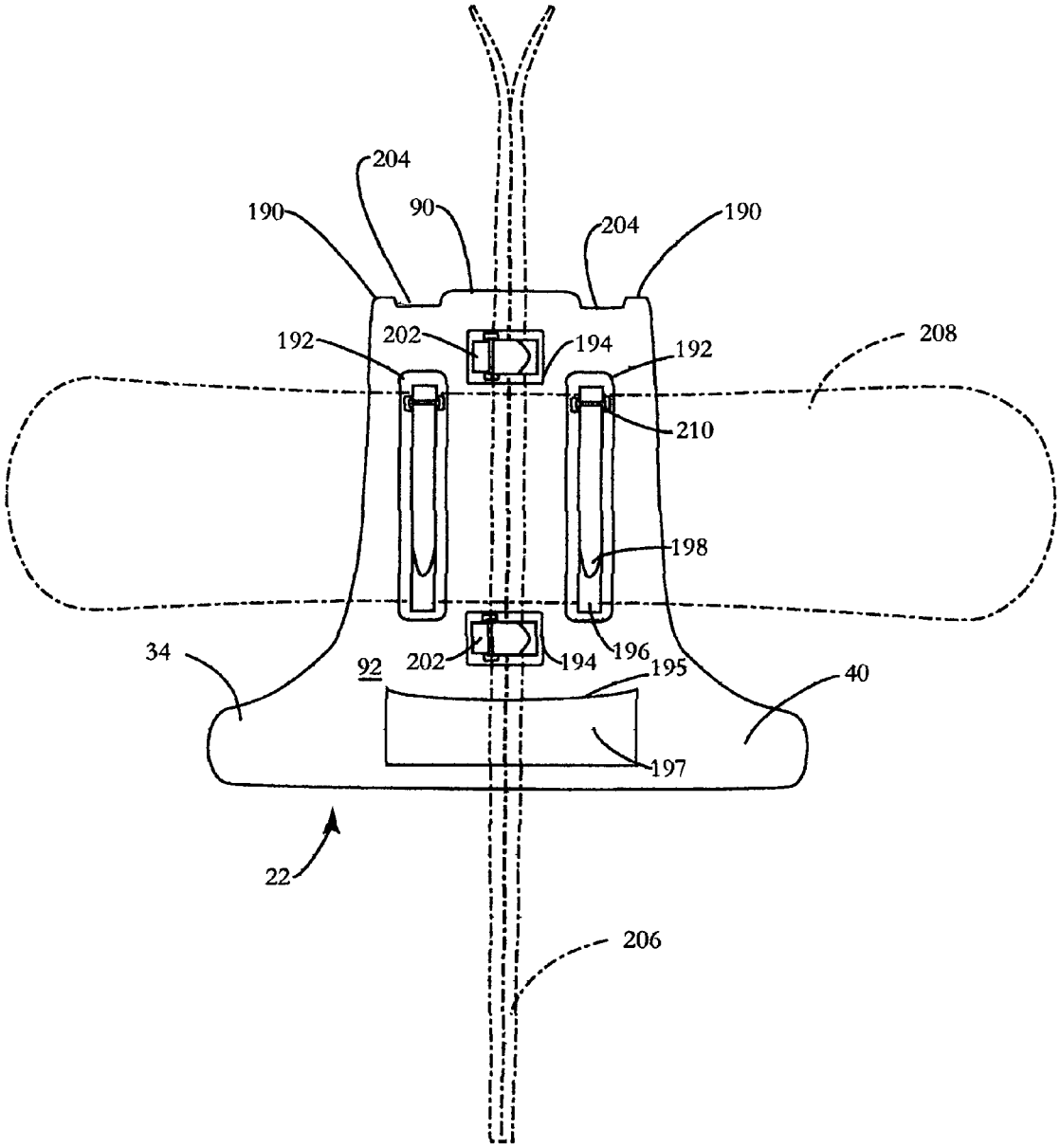
FIG. 13 shows another embodiment of the invention wherein the front wall of the harness panel has mounting straps for securing large or additional equipment.

To retain the upper section of the movable compartment 14 from lateral movement with respect to the harness 12, the top section 30 of the support panel may have a raised tab 90, as shown in FIG. 2. Alternatively, the top section 30 may have a set of raised tabs 94, as shown in FIG. 4, or tabs 190 and recesses 204 as shown in FIG. 13.

Referring again to FIG. 1A, releasable connection 36 may comprise any number of releasable fastening means commonly used in the art. A "releasable connection" or a connection that is releasably fastened or secured is herein defined as a connection that has an engaged configuration that substantially resists motion between interconnecting parts even under heavy static or dynamic loading, and releases from the engaged configuration by actuation or motion other than the loads or forces induced on the connection from user activity.

As shown in FIG. 1A, one such releasable connection means may be a quick release buckle having a male connector 68 and female connector 66 attached to the lower end 26 of the movable compartment 14. Releasable connection 36 may further comprise support strap 62 and adjustable compression strap 64 sewn around the loop of male connector 68 so that the movable storage compartment may be tightly secured to the harness 22. Female connector 66 is may be secured to the padded section 34, 40 of waist belt 20 in a variety of ways, including stitching, bolts, rivets, or the like. Support strap 62 preferably comprises a stiffening element to so that the male connector 68 lines up with the female connector 66 when they are not connected. Releasable connection 36 may comprise a variety of buckles known in the art, such as a side release buckle, center release buckle, can buckle etc.

In many cases, the user will be wearing gloves while fastening or unfastening releasable connection 36. Therefore, it is preferable that the release mechanism be relatively accessible to gloved hands. For example, a side kick release buckle (not shown) may be used to provide additional leverage to releasing the buckle. Other exemplary buckles designed for gloved release are found in U.S. Pat. Nos. 6,678,925, 6,487,761, and 5,832,573, the entire disclosures of which are incorporated herein by reference.

Because loading, varying user anatomy, and differing types of activity may change the orientation of the movable compartment 14 with respect to the harness 22, releasable connection may be coupled with adjustment or tightening means such as compression strap 64. Typically, compression strap 64 comprises adjustable webbing commonly used in the art. A stiffening means, such as that described for the pivotable connection above, may be incorporated with the adjustable webbing of compression strap 64 to maintain alignment with the connection points of the harness 22 and movable compartment 14. Compression straps may also be incorporated at the upper section of the compartment at or near the pivotable connections, for example, at the rotation straps 100 shown in FIG. 11.

Figure 8A:
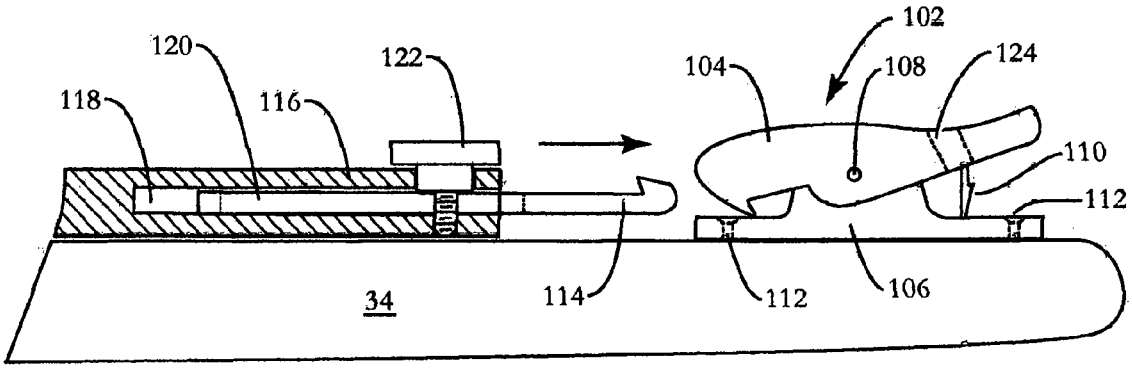
FIG. 8A illustrates a top view of a releasable connection using a tongue and latch in accordance with the present invention.
Figure 8B:
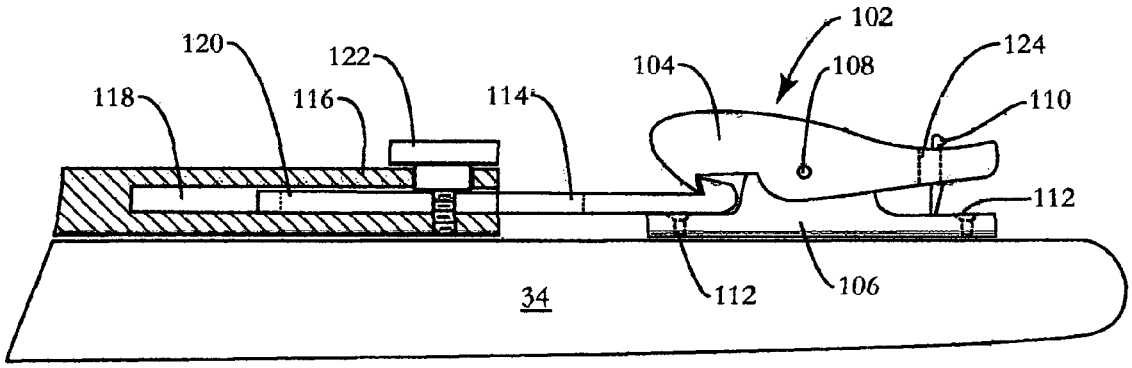
FIG. 8B is an illustration of the releasable connection of FIG. 8*a* in a locked configuration in accordance with the present invention.
Figure 8C:
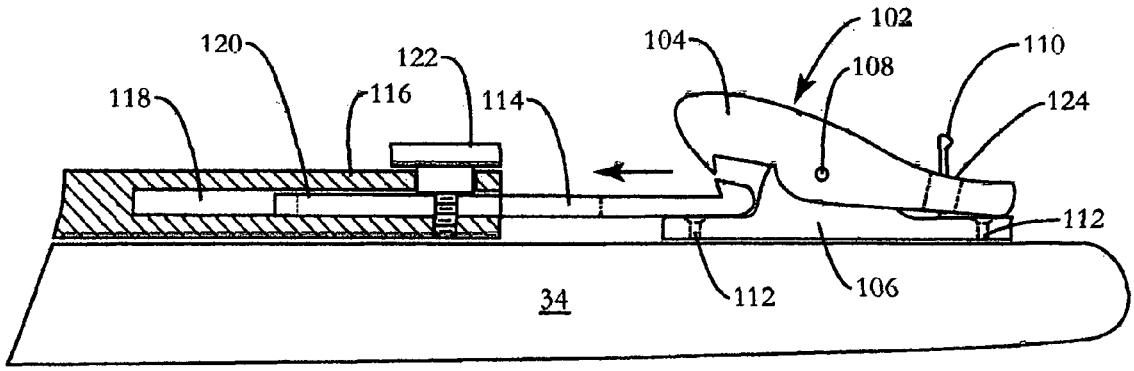
FIG. 8C is an illustration of the releasable connection of FIG. 8*a* in an open configuration in accordance with the present invention.

In one embodiment illustrated in FIGS. 8A-C, the releasable connection comprises a tongue and latch assembly 102. Latch assembly comprises a hook-shaped lever arm 104 pivotably mounted to a base 106 at hinge 108. Base 106 is secured to the outside surface of padded sections 34, 40 of the waist belt 20 by fastener 112. Fastener 112 may comprise a rivet, bolt or other fastener known in the art.

Tongue 114 has a mating hook-like surface to match that of the lever arm 104, and is adjustably mounted to the movable compartment 14 via sleeve 116. Sleeve 116 may attach to the movable compartment 14 at either the lower section 108, flap 62 or stiffening panel 76. Sleeve 116 has a channel 118 sized to receive tongue 114 at different lengths along slot 120 to function as a compression or tightening means to allow the tightening of the movable compartment 14 to the harness. When the desired placement of tongue 114 out of sleeve 116 is found, the tongue 114 is securedly tightened to sleeve 116 by tightening screw 122. Tightening screw 122 may comprise a shoulder screw, or other screw known in the art that has a large head to allow for tightening and un-tightening by hand. As an alternative to the channel/screw compression means described above, a number of tightening means may be employed, such as compression strap 64 shown in FIG. 1, or tongue 114 could be configured to have a serrated surface instead of slot 120 to accommodate a ratchet buckle (such as ratchet buckle 150 shown below in FIG. 9C) attached to sleeve 116 to allow for tightening of the movable compartment to the harness.

To engage tongue 114 with latch 102, tongue 114 is forced in between the lever arm and base 106 until the two mating surfaces catch as shown in FIG. 8B. Hinge 108 may also be loaded with a compression spring or torsion spring (not shown) so that the latching portion of lever arm 104 presses against the tongue 114 when engaged, or base 102 when not engaged. Other latch-type devices such as draw latches or buckles may be used, or those described in U.S. Pat. Nos. 6,347,436 and 5,526,555, incorporated herein by reference.

Figure 9A:
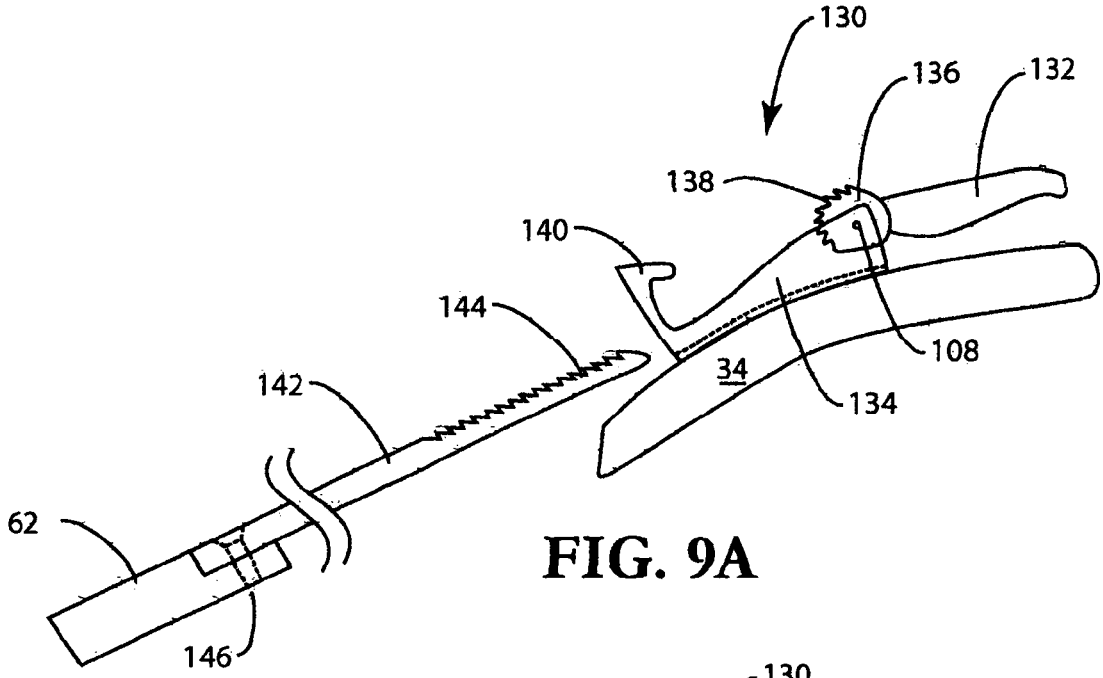
FIG. 9A illustrates a top view of a releasable connection using a ratchet cam assembly in accordance with the present invention.
Figure 9B:
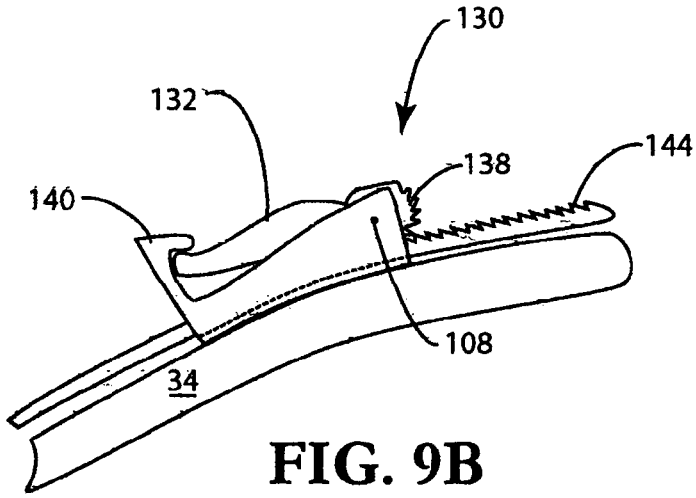
FIG. 9B is an illustration of the releasable connection of FIG. 9*a* in a locked configuration in accordance with the present invention.

Alternatively, releasable connection 36 may comprise a ratcheting cam buckle 130 and serrated strap 142, as illustrated in FIG. 9A-9B. Serrated strap 142 may attach to the movable compartment 14 at either the lower section 108, support strap 62 or stiffening panel 76. Shown in an open position in FIG. 9A, cam lever arm 132 is pivotably attached at hinge 108 to base 134, which is secured to the outer surface of padded sections 34, 40 of waist belt 20. Lever arm 132 has a pawl 136 having pawl teeth 138 and is spaced from the bottom of the base such that when serrated strap teeth 144 of tongue 142 engage the pawl teeth 138 when the tongue is inserted into the base. Lever arm 132 may then be rotated toward retainer 140, thereby advancing the serrated strap and support strap 62 to tighten compartment 14 to the harness. Retainer 140 is preferably flexible to allow lever arm to snap under the ledge of retainer 140 when pressure is applied on the lever arm 132 down on the retainer 140, as shown in a locked position in FIG. 9C. To release, lever arm 132 can be pulled away from lever arm 132, allowing the serrated strap to release from the pawl 136 of the lever arm. Support strap 62 may further comprise adjustment and compression means as shown in FIGS. 8A-C.

Figure 9C:
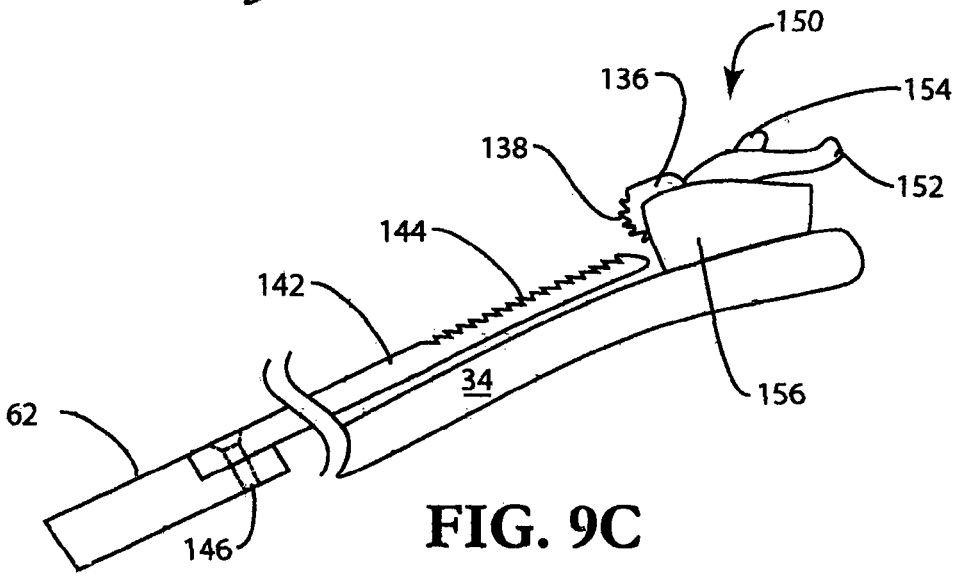
FIG. 9C illustrates a top view of a releasable connection using a ratchet buckle in accordance with the present invention.

Alternatively, releasable connection 36 may comprise a ratchet buckle assembly 150 and serrated strap 144, as illustrated in FIG. 9C. Ratchet buckle assembly 150 may comprise any ratchet buckle, as used for snowboard binding straps commonly known in the art, such as U.S. Pat. Nos. 5,745,959 and 5,416,952, incorporated herein by reference. Serrated strap 144 may be sewn or riveted to support strap 62. Ratchet buckle is fastened to padded section of waist belt 20. The ratchet assembly 150 allows for tightening of the movable storage compartment to the harness panel 22 by ratcheting the serrated strap 144 into the ratchet buckle by pulling on lever 152. To unlock the serrated strap 144 from the ratchet buckle 150, release lever 154 is pulled back to disengage pawl 136 from the teeth of the serrated strap. This configuration has the benefit of a flexibly rigid and adjustable attachment so that the serrated strap 144 repeatedly lines up with the ratchet buckle 150, while still allowing for adjustment/tightening means so that the movable compartment can be tightened securely to the harness. Preferably, flap 62 and back wall of movable compartment have integral stiffening means that provide a semi-rigid flexibility in bending and high rigidity in tension so that the ratchet can be buckled to a high tensile load without damaging the flap or the movable compartment.

Figure 10A:
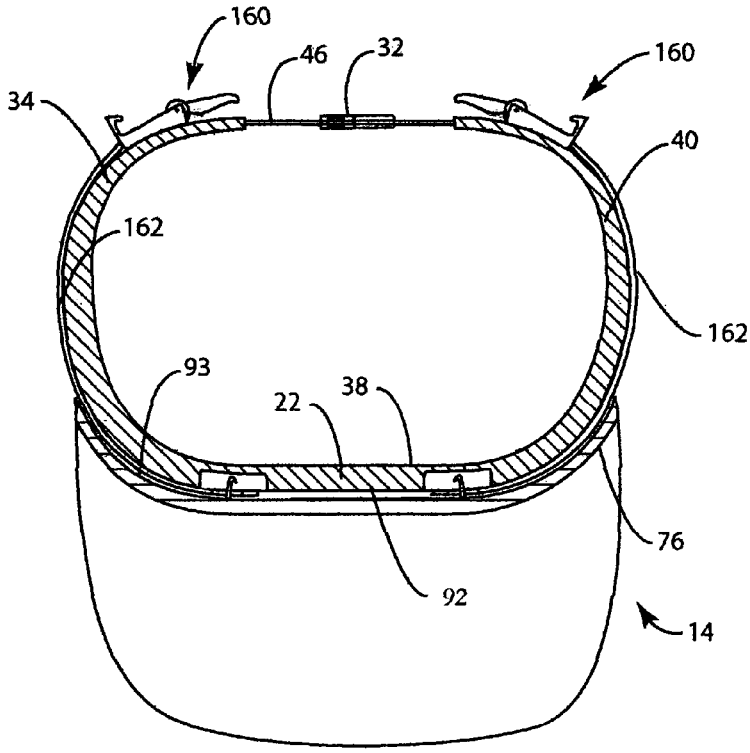
FIG. 10A is a cross-sectional view of a backpack of the present invention having a releasable connection using a cam-actuated compression strap.
Figure 10B:
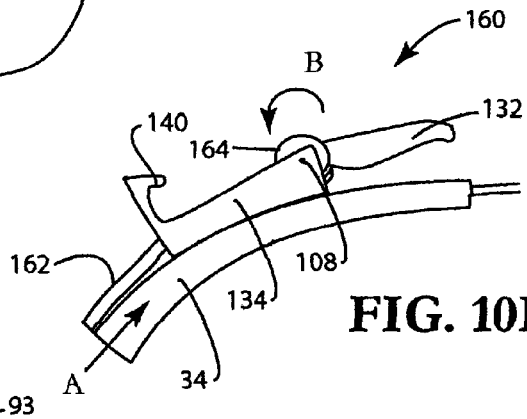
FIG. 10B is an expanded view of cam of FIG. 10*a* in an open configuration.
Figure 10D:
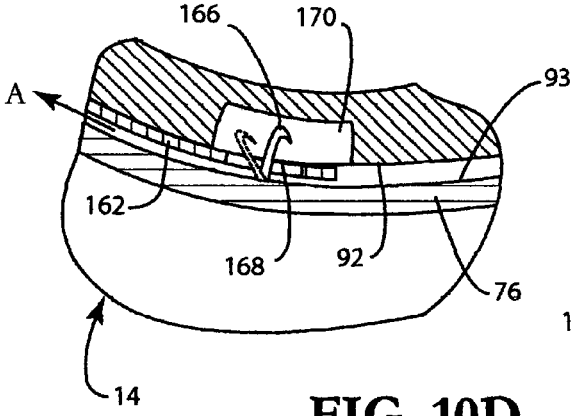
FIG. 10D is an expanded cross-sectional view of the interface shown in FIG. 10*a*.
Figure 10C:
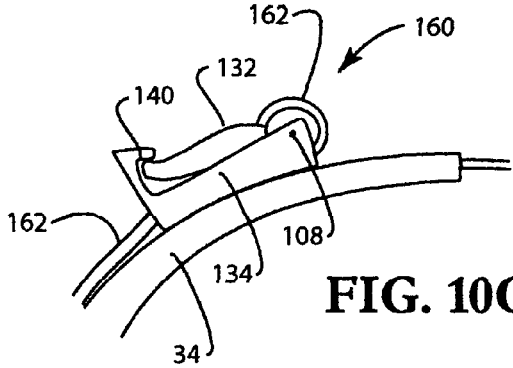
FIG. 10C is an expanded view of cam of FIG. 10*a* in a closed configuration.

Now referring to FIGS. 10A-C, an alternative embodiment using a tension belt as a releasable connection is illustrated. A cam buckle assembly 160, illustrated in an open configuration in FIGS. 10A and 10B, comprises a lever arm 132 coupled to a mandrel 164 that is rotatably connected to bracket 134 at hinge 108. Preferably a left and right cam buckle assembly 160 are positioned on the front end of hip belt 34,40 so that both sides of the movable compartment are equally secured to the harness. Tension belt 162 is attached at a first end to the bottom side of mandrel 164, and a second end of the tension belt is follows the outside contour of the hip belt 34,40 to the front wall 92 of the harness panel 22. Tension belt 162 may be retained to the outside surface of the hip belt by loops, or alternatively underneath a sheet of fabric (not shown) that is sewn to the hip belt 34, 40 to create a channel for the tension belt. The second end of the tension belt 162, while being retained to the outer contour of the hip belt, is free to advance or slide along the hip belt in direction A as shown in FIG. 10B. The second end of tension belt 162 has slot 168 that is adjacent recess 170 in the front wall 92 support panel 22. The back surface 93 of movable compartment 14 has a tension catch 166 that is aligned with slot 168 tension belt 162 and recess 170 such that the catch 166 freely advances through slot 168 and into recess 170 when the movable compartment 14 is placed adjacent to the harness in its stowed position.

To secure the movable compartment, both lever arms of cam buckles 160 are rotated in direction B toward locking tab 140 of bracket 134 as illustrated in FIG. 10C, such that tension belt 162 is wrapped around mandrel 164, advancing the free end of tension belt 162 along the hip belt in direction A. As tension belt 162 advances, slot 168 hooks on to catch 166. Catch 166 may be semi-flexibly attached to the stiffening panel 76 of the movable compartment such that a tensile force is created as the catch 166 deforms (illustrated as phantom lines in FIG. 10D). Tensile force from the tension belt 162 secures the movable compartment to the harness panel to retain it from shifting or sliding during motion or impact.

In another alternative backpack 175 illustrated in FIGS. 11 and 12, movable compartment 15 is connected to the shoulder pads of harness 12 by rotation straps 100. The rotation straps are connected at one end to the top of the movable compartment 14 with reinforcement material 174. At the other end, rotation straps are looped around fastening loops 60 and retained by stitching, a fastener or the like. Hook and loop material 172 may also be provided between the rotation strap 100 and the top section 30 of the support panel 22 or shoulder pad to provide further stability against lateral movement of the movable compartment with respect to the harness.

Referring now to FIG. 12, movable compartment 15 may be moved from its stowed position (shown as phantom lines 180) by releasing releasable connection 36 at the hip belt. The wearer can then advance the movable compartment 14 to a frontal position (shown as phantom lines 182) by pulling on compression strap 64 or grasping handle 70 and pulling the movable compartment over the wearer's shoulders and head about the fastening loops 60. The rotation straps 100 (or U-shaped section of the main compartment shown in FIG. 1) are sized to provide clearance for the movable compartment 15 over the wearer's head as it is rotated to and from the stowed position 180 to frontal position 182. With the movable compartment in the frontal position 182, the articles inside of the compartment can readily be accessed without having to remove the backpack.

Referring to FIG. 11, the harness panel 22 may also have a recess 176 for carrying a hydration bladder (not shown) or the like. In such a configuration, access port 178 may be located at the top of the harness panel 22 so that a hydration tube (not shown) coupled to the bladder may be directed toward the front of the user. Storing the hydration bladder in a separate compartment such as the support panel 22 has several benefits, including separating the bladder from bulky gear that can damage the bladder, avoiding possible interruption of fluid delivery, and allowing the maximum capacity for storage in the movable compartment the can be limited with a full bladder.

Still referring to FIG. 11, the support strap 62 and compression strap 64 may be oriented downward by angle $\phi$. Angle $\phi$ may generally range from 5-45 degrees to create a vertical tensile load as well as a lateral load when the compression strap is tightened. Thus the movable compartment 15 is restrained from rotation and translation outward and laterally from harness 12, in addition to rotation and movement upward in relation to the harness. It will be appreciated that the movable compartment 14 shown in FIG. 1 may also be restrained laterally and vertically by orienting support strap 62 at angle $\phi$.

Now referring to FIG. 13 (showing the harness panel with the movable compartment removed), the front wall 92 of support panel 22 may optionally have mounting straps 196, 202 for securing large equipment to the pack between the harness and the movable compartment. For example, a snowboard 208 may be secured to the harness 22 by tightening the ends 198 of the mounting straps 196 within loops 210. In addition, a pair of skis 206 may be attached to the harness 22 with straps 202. Recesses 192, 194 may be provided in the support panel so that the mounting straps and loops do not protrude from the front wall 92 of the support panel. Front wall 92 may also have a pocket 197 sewn to the front wall 92 on three sides to form an opening 195. The pocket 197 may be used to retain additional gear such as a shovel (not shown), wherein the blade of the shovel is retained in the pocket 197, and handle is retained by either or both of straps 202. It would be understood to one skilled in the art that the mounting straps could be sized and oriented in a number of configurations, e.g. horizontal, vertical, or diagonal. Additional mounting straps may be disposed on the exterior surface of the movable compartment to interchangeably attach the above gear to a plurality of different possible locations.

Figure 14:
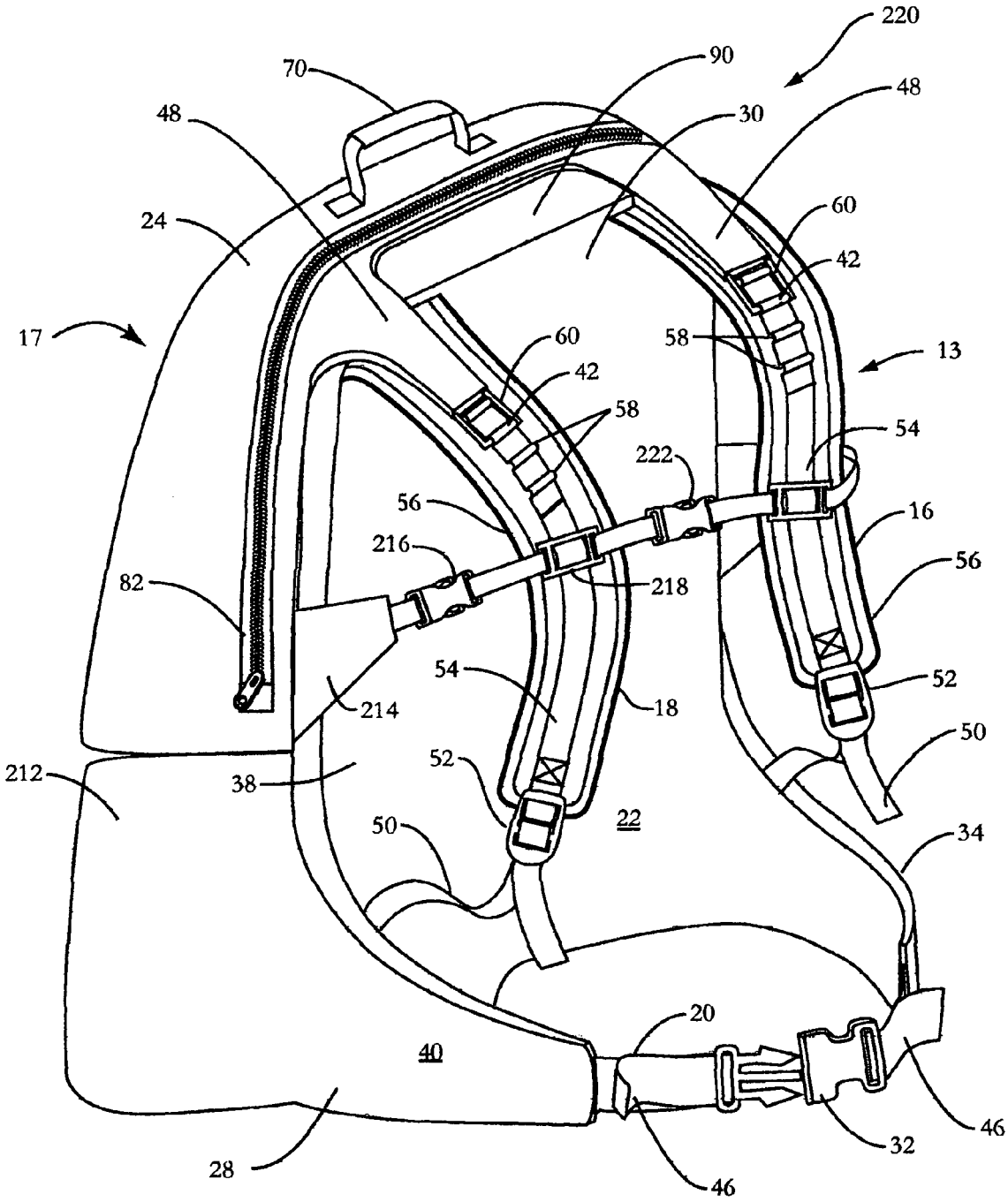
FIG. 14 illustrates yet another embodiment of the invention wherein the movable compartment comprises an upper of two storage compartments.

FIG. 14 illustrates an alternative embodiment of the invention wherein the backpack 220 comprises a movable compartment 17, which is the upper of two movable compartments. The lower movable compartment 212 is attached or integrated with the lower section 28 of the harness panel 22. The movable compartment 17 is attached to a frontal position on the left and right shoulder straps 18 and 16 via support straps 214 and releasable connections 216. Releasable connections 216 may comprise quick release buckles as shown in FIG. 14, or any other connector known in the art or described in the embodiments disclosed above. To keep the shoulder straps from moving outward from the center of the torso, sternum strap 222 laterally connects the left and right shoulder straps together via sliders 218 slidably attached to the mounting straps 54. The upper section 24 of movable compartment is attached via pivotable connections 42 to the upper section 30 of the harness 13 such as the left and right shoulder straps 16, 18. In this configuration, movable compartment 17 may be rotated to the front of the user upon release of releasable connections 216, while the lower compartment 212 remains at the back of the user. Lower compartment may be configured with openings (not shown) and capacity to store items that are not as frequently accessed as those placed in the movable compartment 17.

Figure 15:
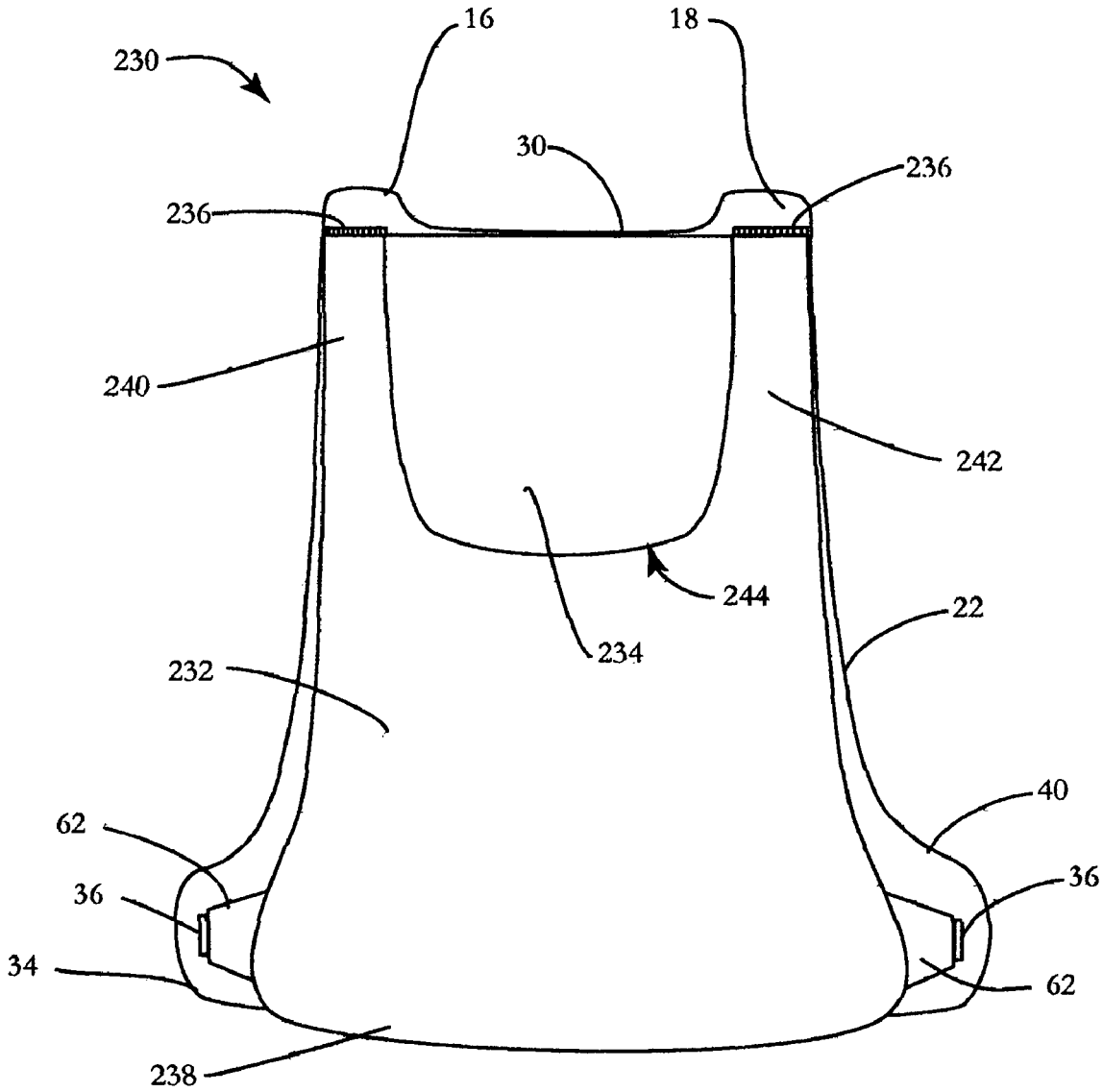
FIG. 15 is a rear view of another embodiment of the invention wherein the movable compartment is the lower of two storage compartments.

Now referring to FIG. 15, yet another embodiment of the invention is illustrated showing a rear view of backpack 230. Backpack 230 has a movable compartment 232 that left and right arms 240, 242 at its upper end. Left and right arms 240 and 242 form a U-shaped recess 244 to allow clearance for the movable compartment 232 when being rotated to the front of the user. A fixed upper compartment 234 may be fastened to the support panel 22 and have a shape matching that of recess 244 so that the movable compartment 232 is restrained from lateral motion while fastened in the stowed position as shown in FIG. 15.

The movable compartment 232 is pivotably connected at its upper arms 240, 242 to the upper end 30 of the harness support panel 22 (or shoulder straps 16,18) by pivotable connections 236. Movable compartment 232 is releasably fastened at its lower end 238 to the left and right padded sections 34, 40 of the hip belt via support straps 62 and releasable connections 36. Upper compartment 234 may have openings (not shown) to allow articles to be stored in the compartment that generally don't need to be accessed as frequently as articles in the movable compartment. Movable compartment 232 may be unfastened from releasable connection 36 to allow the movable compartment to be rotated over the head of the user to the front of the user. When worn on a ski lift, upper compartment 234 will be generally high enough on the back of the user to be above the ski lift back rest so as not to interfere with the backrest. In an alternative embodiment (not shown) the upper compartment 234 may be detachable from the support panel 22 to allow for mounting of gear, or support panel 22 may be flat at the area adjacent to recess 244, without an additional compartment.

Figure 16:
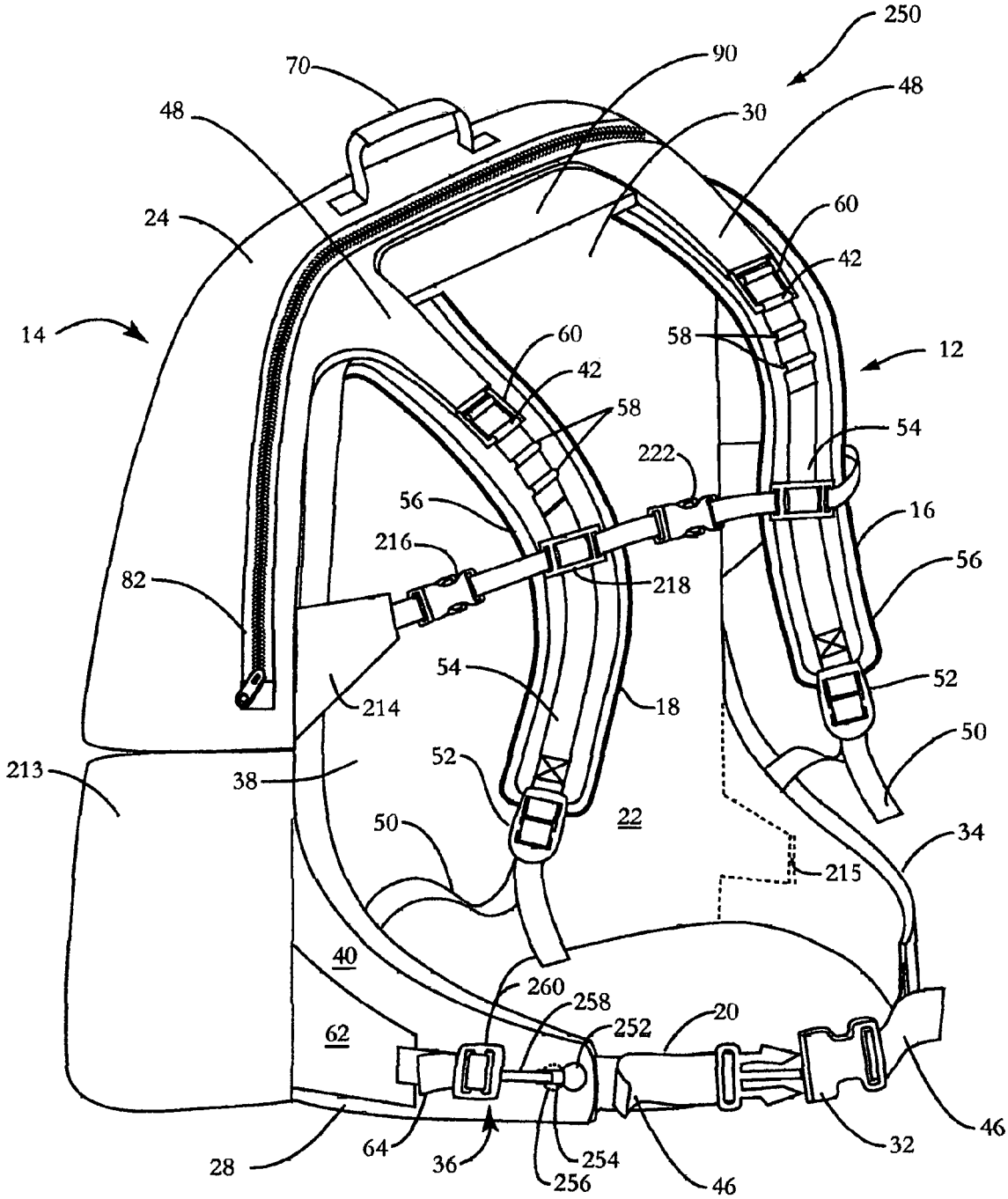
FIG. 16 shows a perspective view of an embodiment of the invention having a lower movable compartment that rotates laterally about the hip of the user.

In an alternative embodiment shown in FIG. 16, backpack 250 has a lower movable compartment 213 that is pivotably connected at 215 on the left waist belt pad 34, and releasably connected to the right waist belt pad 40. The pivotable connection 215 may also be located at the left edge of the support panel 22 of the harness 12. Thus, when the releasable side is disconnected, the lower compartment 213 may be swung around the hip about the rotatable connection to the front of the user. The upper compartment 19 may be rotatably/releasably connected as shown in FIG. 16, or fixed to the harness by stitching (not shown).

Releasable connection 36 may comprise an interlocking connector 260 having a T-shaped arm 258 with an oval-shaped tip 256 such that the arm 258 may be inserted into circular slot 252 embedded into hip pad 40. The connector 260 may then be slid toward down the narrow end 254 of the slot to engage the connector with the hip pad. Compression strap 64 may then be tightened to secure the lower end movable compartment 212 to the harness. Interlocking connector 260 and slot 252 may be used to releaseably secure movable compartment 10 shown in any of FIGS. 1A, 1B or 11.

Figure 17:
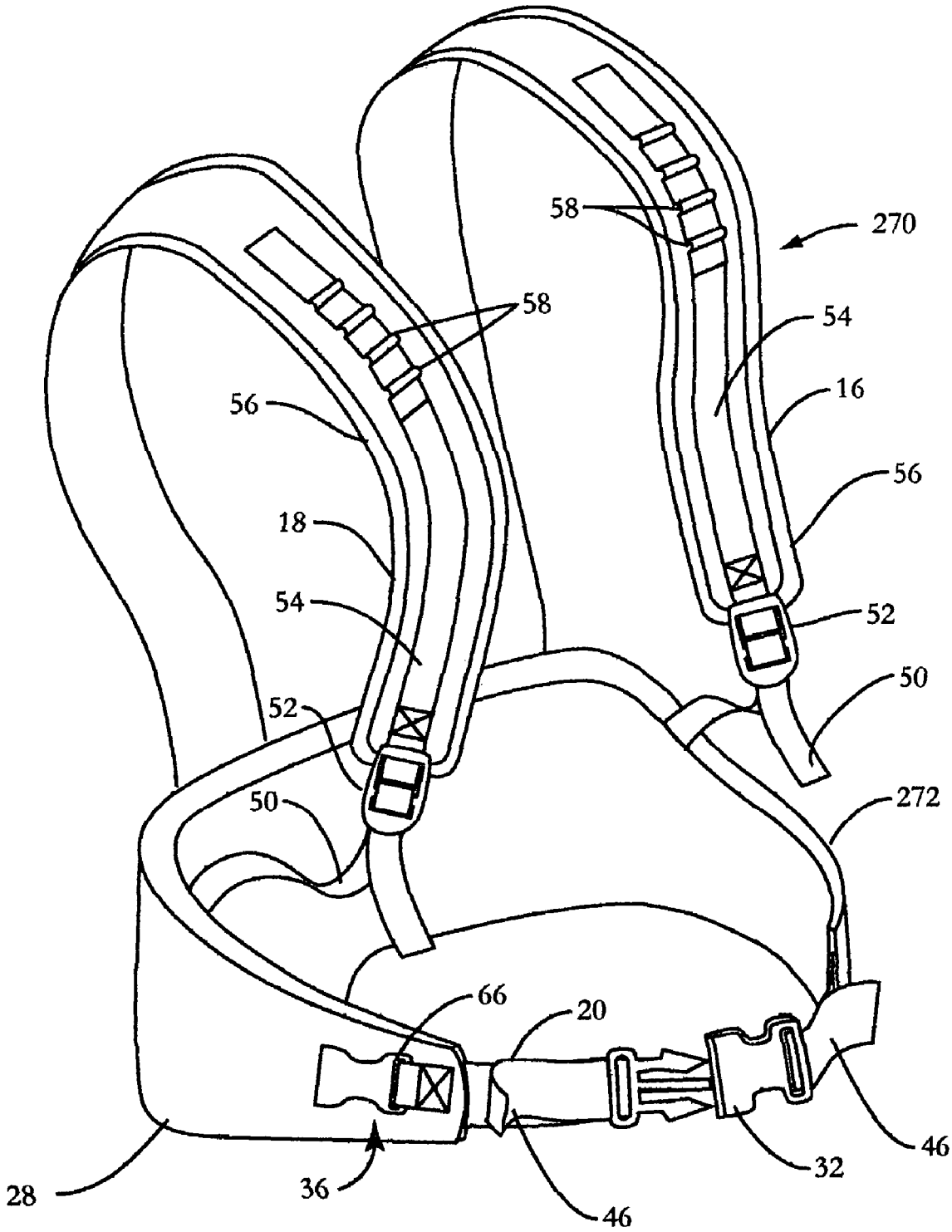
FIG. 17 illustrates a harness of the present invention without a support panel.

Now referring to FIG. 17, the harness 270 may comprise left and right shoulder straps 16, 18 that directly attach at their ends to hip belt 272. A chest strap (not shown) similar to that of the embodiment shown in FIG. 16 may also be used to prevent the shoulder straps from separating laterally from the user's chest. This configuration of harness 270 minimizes weight while still providing a platform to mount the pivotal and releasable connections.

Although the description above contains many details, these should not be construed as limiting the scope of the invention but as merely providing illustrations of some of the presently preferred embodiments of this invention. For example, it will also be appreciated that any of the releasable connections, pivotable connections, adjustment or tightening means, harness panels, movable compartments, stiffening means, chest strap herein described may be interchangeably configured where practical to form a number of combinations and configurations not explicitly described or illustrated in the above description. It will further be appreciated that although the particular embodiments described herein may be particularly useful for skiing and snowboarding, the backpack of the present invention may be modified, without departing from the general principles herein described, in size and shape to more particularly pertain to any one of a number of outdoor activities, e.g. backpacking or cycling. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A backpack comprising:

a harness configured to securedly attach to a person's torso;

the harness comprising a waist belt configured to detachably secure around the torso;

a movable storage compartment having an upper portion and a lower portion;

a pivotable connection pivotally connecting the upper portion of the movable compartment to an upper section of the harness to allow reorientation of the movable compartment from a stowed position to a frontal position on the user;

a releasable connection releasably connecting the lower portion of the movable compartment to the waist belt;

wherein the releasable connection is at a location on the waist belt that is at an anterior side of the torso while the person is wearing the backpack with the hip belt secured around the torso;

wherein motion of the movable compartment with respect to the harness is substantially locked in the stowed position with the moveable compartment located at a posterior side of the torso and substantially spaced apart from the releasable connection when the releasable connection is engaged;

wherein the releasable connection is configured to disengage so that the movable compartment may be reoriented from the stowed position to a frontal position on the user;

wherein the releasable connection is located at a frontal location of the lower section of the harness such that the releasable connection may be accessed and released while the backpack is being worn by the person;

wherein the pivotable connection comprises first and second pivotable connections, the first and second pivotable connections being laterally spaced apart at the upper section of the harness;

wherein the moveable compartment is contiguous from the first pivotable connection to the second pivotable connection such that the first and second pivotable connections simultaneously rotate when the compartment is moved from the stowed position to the frontal position on the user;

wherein the upper portion of the movable compartment comprises a recess extending downward from and spanning contiguously in between the first and second pivotable connections when the moveable compartment is in the stowed position on the user; and wherein the recess is of sufficient size to provide clearance for the movable compartment as it is rotated over the person's head from the stowed position to the frontal position on the user.

2. A backpack as in claim 1, wherein the harness comprises:

left shoulder strap;

right shoulder strap; and a support panel the support panel having a back wall adjacent to the user's back and a front wall adjacent to the movable compartment when in the stowed position;

the support panel further having an upper end attached to a first end of each of the left and right shoulder straps and a lower end attached to a second end of the left and right shoulder straps;

wherein the waist belt is affixed to the lower end of the support panel.

3. A backpack as in claim 2, wherein the front wall of the support panel further comprises one or more holding straps to carry an elongate article.

4. A backpack as in claim 1, wherein the recess is shaped such that the upper portion of the moveable compartment forms a u-shape around the recess;

wherein the recess comprises a lowest vertical extent that is substantially centered between the first and second pivotable connections; and wherein the moveable compartment does not extend vertically above the first and second pivotable connections at the lowest vertical extent of the recess.

5. A backpack as in claim 2, wherein the upper portion of the movable compartment is pivotably connected via first and second pivotable connections on the left and right shoulder straps, and the lower portion of the movable compartment is releasably fastened to the waist belt at a location accessible to the user while wearing the backpack.

6. A backpack as in claim 5, wherein the movable compartment further comprises left and right rotation straps;

wherein the left rotation strap is pivotally connected at a first end via the first pivotable connection to the left shoulder strap, and wherein the right rotation strap is pivotally connected at a first end via the second pivotable connection to the right shoulder strap; and wherein the first and second rotations straps are connected at seconds ends to the moveable compartment such that the recess is disposed between the first and second rotations straps; and wherein the moveable compartment does not extend vertically above the connections at the second ends with the compartment.

7. A backpack as in claim 5, wherein the first and second pivotable connections are configured to slideably translate along the left and right shoulder straps when the second end of the movable compartment is in a disengaged configuration.

8. A backpack as in claim 2, wherein the releasable connection comprises first and second releasable connections laterally spaced apart at frontal locations on the waist belt;

wherein said first and second releasable connection locations are spaced apart from the moveable compartment to allow access to the first and second releasable connections while the backpack is being worn by the user.

9. A backpack as in claim 8, further comprising left and right support straps;

wherein the left support strap is fixed at a first end to a left side of the lower portion of the movable compartment, and the right support strap is fixed at a first end to a right side of the lower portion of the movable compartment; and wherein a second end of the left support strap is connected to the waist belt via the first releasable connection and a second end of the right support strap is connected to the waist belt via the second releasable connection.

10. A backpack as in claim 8, further comprising a tightening means coupling the movable compartment to the harness, the tightening means compressing the movable compartment onto the harness.

11. A backpack comprising:

a harness having a support panel, waist belt and left and right shoulder straps, wherein the support panel has a back wall configured to be secured adjacent to a person's back when the left and right shoulder straps are positioned on the person's shoulders, and a front wall spaced apart from the person's back; and a movable compartment having a first end and a second end opposite the first end;

wherein the movable compartment is pivotably connected at the first end to laterally spaced apart locations on a first section of the harness;

wherein the moveable compartment is contiguous from the laterally spaced apart connections such that the moveable compartment rotates simultaneously about the laterally spaced apart connections when the compartment is moved from a stowed position to a frontal position on the user;

wherein the first end of the movable compartment has a recess extending downward from and spanning contiguously in between the spaced apart locations when the moveable compartment is in the stowed position on the user;

wherein the second end of the of the movable compartment is releasably fastened with a releasable connection to the waist belt;

wherein the releasable connection is at a location on the waist belt that is at an anterior side of the person's torso while the person is wearing the backpack with the hip belt secured around the torso;

wherein the movable compartment is secured to the harness in the stowed position adjacent to the front panel of the harness position with the moveable compartment located at a posterior side of the torso substantially opposite the anterior side and substantially spaced apart from the releasable connection to restrain motion of the movable compartment with respect to the harness until the second end of the movable compartment is released from the harness;

wherein, upon release, the movable compartment is configured to be pivoted about its first end from the stowed position to the frontal position on the person.

12. A backpack as in claim 11, wherein the movable compartment comprises an inner wall and an outer wall; and wherein the backpack is configured to allow one or more pieces of equipment to be mounted between the front wall of the harness and the and the inner wall of the movable compartment.

13. A backpack as in claim 12, further comprising one or more holding straps attached to the outer wall of the support panel so that an elongate article may be fastened between the harness and the movable compartment.

14. A backpack as in claim 11, wherein the harness further comprises an upper section attached to a first end of each of the left and right shoulder straps, and a lower section attached to a second end of the left and right shoulder straps, the waist belt being affixed to the lower section of the harness;

wherein the first end of the movable compartment is pivotably connected at two laterally spaced apart locations on the upper section of the harness; and wherein a second end of the of the movable compartment is releasably fastened at two laterally spaced apart locations on the waist belt;

wherein said laterally spaced apart locations on the waist belt are spaced away from rear compartment to allow access to the releasable connections while the backpack is being worn by the user.

15. A backpack comprising:

a harness configured to be secured on a person's torso;

said harness having left and right shoulder straps coupled to a waist belt;

a movable compartment comprising first and second opposing ends configured to be received on said harness;

first and second pivotable connections pivotally connecting the first end of the movable compartment to a first location on the left shoulder strap and a second connection on the right shoulder strap;

wherein the moveable compartment is contiguous between the first location and the second location; and wherein the moveable compartment comprises left and right straps at said second end that are configured to circumscribe laterally around at least a portion of the torso to attach at a releasable connection;

wherein the releasable connection is at a location at an anterior side of the torso while the person is wearing the backpack with the hip belt secured around the torso;

wherein motion of the movable compartment with respect to the harness is substantially locked in a stowed position with the moveable compartment located at a posterior side of the torso and substantially spaced apart from the releasable connection when the releasable connection is engaged;

wherein, upon release of the second end of the movable compartment from the harness, the movable compartment has a recess that spans the first and second pivotable connections and extends downward from the pivotable connections the recess and is shaped so that the moveable compartment may be manually rotated about the first and second locations on the harness simultaneously from the stowed position to a frontal position on the person.

16. A backpack as recited in claim 15, wherein the releaseable connection is at a location that is accessible to the person while the backpack is secured to the person's torso.

17. A backpack as recited in claim 15, further comprising an adjustment means coupling the movable compartment with the harness, the adjustment means allowing the movable compartment to be tightened to the harness.

18. A backpack as recited in claim 15, further comprising a stiffening means coupled to the movable compartment, the stiffening means retaining alignment of the movable compartment with the harness.

* * * * *